US008761651B2

(12) United States Patent
Yoshida et al.

(10) Patent No.: US 8,761,651 B2
(45) Date of Patent: Jun. 24, 2014

(54) IMAGE FORMING APPARATUS

(75) Inventors: Ryuji Yoshida, Kanagawa (JP); Nobuyuki Koinuma, Kanagawa (JP); Mugijirou Uno, Kanagawa (JP); Tomoko Takahashi, Kanagawa (JP); Mikio Ishibashi, Kanagawa (JP); Hideki Zemba, Kanagawa (JP); Yoshinori Nakagawa, Kanagawa (JP); Shunichi Hashimoto, Kanagawa (JP); Naoyuki Ozaki, Kanagawa (JP); Hideaki Kanaya, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 146 days.

(21) Appl. No.: 13/137,014

(22) Filed: Jul. 15, 2011

(65) Prior Publication Data

US 2012/0045262 A1 Feb. 23, 2012

(30) Foreign Application Priority Data

Aug. 18, 2010 (JP) ..... 2010-183487

(51) Int. Cl.
*G03G 15/20* (2006.01)

(52) U.S. Cl.
USPC ..... 399/330; 399/340

(58) Field of Classification Search
USPC ..... 399/340, 238, 239, 248, 390, 307, 122; 430/124.21, 124.22, 124.1; 118/694
See application file for complete search history.

(56) References Cited

U.S. PATENT DOCUMENTS 2,139,652 A * 12/1938 Becker ..... 118/249
3,601,092 A * 8/1971 Satomi ..... 399/240
2007/0098469 A1 5/2007 Yoshino et al.
2008/0135160 A1 6/2008 Iwasaki et al.
2008/0170896 A1* 7/2008 Kubota et al. ..... 399/340
2011/0064475 A1 3/2011 Yoshida et al.
2011/0064488 A1 3/2011 Takahashi et al.
2011/0151370 A1 6/2011 Shitara et al.

FOREIGN PATENT DOCUMENTS

CN 101178550 5/2008
CN 102103338 6/2011
JP 2007301818 A 11/2007
JP 2008149259 A 7/2008

(Continued)

OTHER PUBLICATIONS

Abstract of Japanese Patent Publication No. JP2004-109747, published on Apr. 8, 2004.

(Continued)

*Primary Examiner* — David Gray
*Assistant Examiner* — Sevan A Aydin
(74) *Attorney, Agent, or Firm* — Harness, Dickey & Pierce, P.L.C.

(57) ABSTRACT

An image forming apparatus, including a fixing liquid applicator applying a fixing liquid including a plasticizer swelling and softening a toner forming a toner image to fix on a recording medium thereto before bearing the toner image; a transferer transferring the toner image on a toner image bearer onto the recording medium while contacting the toner image to the fixing liquid thereon; and a fixing device heating the toner image and the fixing liquid to fix the toner image thereon, wherein the fixing liquid applicator comprises an application member bearing the fixing liquid on its surface and apply the liquid on a surface of the recording medium the toner image is transferred onto; a feeder feeding the fixing liquid to the application member; and an inducement mechanism inducing the fixing liquid pooling at a delivery point where the feeder feeds the fixing liquid to the application member out of the point.

18 Claims, 16 Drawing Sheets

(56) References Cited

FOREIGN PATENT DOCUMENTS

| | | | |
|---|---|---|---|
| JP | 4224076 | A | 2/2009 |
| JP | 2009039977 | A | 2/2009 |
| JP | 2009095990 | A | 5/2009 |
| JP | 4354164 | A | 10/2009 |
| JP | 4668032 | | 4/2011 |

OTHER PUBLICATIONS

Absract of Japanese Patent Publication No. JP2007-121652, published on May 17, 2007.

Abstract of Japanese Patent Publication No. JP2007-279160, published on Oct. 25, 2007.

* cited by examiner

IMAGE FORMING APPARATUS

BACKGROUND OF THE INVENTION

1. Field of the Invention

The present invention relates to an image forming apparatus forming an image by fixing toner forming a toner image on a recording medium such as paper upon application of heat, and more particularly, to an image forming apparatus such as a copier, facsimile machine, or printer forming an image thereby, using a fixing liquid such that the toner is suitably fixed on the recording medium.

2. Discussion of the Related Art

Conventionally, image forming apparatuses such as copiers, facsimiles, and printers forming an image by fixing toner forming a toner image on a recording medium such as paper upon application of heat are widely known. In the image forming apparatuses, since toner is softened with heat and fixed on a recording medium, the toner needs to be sufficiently softened at apart contacting the recording medium to have good fixability, which in turn requires much energy. However, demands for saving energy in image forming apparatuses are now increasing. Considering that the ratio of power needed to heat the toner to total power consumption in an image forming apparatus is comparatively high, it is desired to reduce the power consumption needed to heat the toner.

To achieve this reduction in power consumption, a number of different approaches have been tried, involving techniques that add a fixing liquid, by direct or indirect methods, before or after image formation, to soften or transform the toner in order to fix the toner image on the recording medium without the need to use heat.

However, these methods of forming images, which use a liquid for improving the fixability of the toner to reduce the amount of electric power needed for heating the toner in order to fix the image on the recording medium without image distortion, have not been found capable of application to liquid as well as non-liquid development technologies due to problems such as uncontrolled scattering of the liquid, the large amount of power consumed in drying, the lengthening of the time required for fixing the image, the possible adverse effects on interior components of the image forming apparatus, and the difficulty in avoiding degradation of the capabilities of the liquid.

SUMMARY OF THE INVENTION

Accordingly, an object of the present invention is to provide an image forming apparatus that is not limited to liquid development, fixing a toner image with a fixing liquid without image distortion, increase of power consumption and fixing time, adverse effects on the inner parts and uneven amount of the fixing liquid coated on a recording medium.

To achieve such objects, the present invention contemplates the provision of an image forming apparatus, comprising:

a fixing liquid applicator configured to apply a fixing liquid comprising a plasticizer swelling and softening a toner forming a toner image to be suitable for fixing on a recording medium to the recording medium before bearing the toner image;

a transferer configured to transfer the toner image on a toner image bearer onto the recording medium while contacting the toner image to the fixing liquid on the recording medium; and a fixing device configured to heat the toner image and the fixing liquid to fix the toner image on the recording medium, wherein the fixing liquid applicator comprises:

an application member configured to bear the fixing liquid on its surface and apply the liquid on a surface of the recording medium the toner image is transferred onto;

a feeder configured to feed the fixing liquid to the application member; and an inducement mechanism configured to induce the fixing liquid pooling at a point where the feeder feeds the fixing liquid to the application member out of the point.

These and other objects, features and advantages of the present invention will become apparent upon consideration of the following description of the preferred embodiments of the present invention taken in conjunction with the accompanying drawings.

BRIEF DESCRIPTION OF THE DRAWINGS

FIG. 27 is an enlarge schematic cross-sectional view illustrating a fixing liquid inducing member of the fixing liquid applicator in FIG. 26;

DESCRIPTION OF THE PREFERRED EMBODIMENTS

Generally, the present invention provides an image forming apparatus which is not limited to a liquid development, fixing a toner image with a fixing liquid without image distortion, increase of power consumption and fixing time, adverse effects on the inner parts and uneven amount of the fixing liquid coated on a recording medium.

More particularly, the present invention relates to an image forming apparatus, comprising:

a fixing liquid applicator configured to apply a fixing liquid comprising a plasticizer swelling and softening a toner forming a toner image to be suitable for fixing on a recording medium to the recording medium before bearing the toner image;

a transferer configured to transfer the toner image on a toner image bearer onto the recording medium while contacting the toner image to the fixing liquid on the recording medium; and a fixing device configured to heat the toner image and the fixing liquid to fix the toner image on the recording medium, wherein the fixing liquid applicator comprises:

an application member configured to bear the fixing liquid on its surface and apply the liquid on a surface of the recording medium the toner image is transferred onto;

a feeder configured to feed the fixing liquid to the application member; and an inducement mechanism configured to induce the fixing liquid pooling at a point where the feeder feeds the fixing liquid to the application member out of the point.

Figure 1:
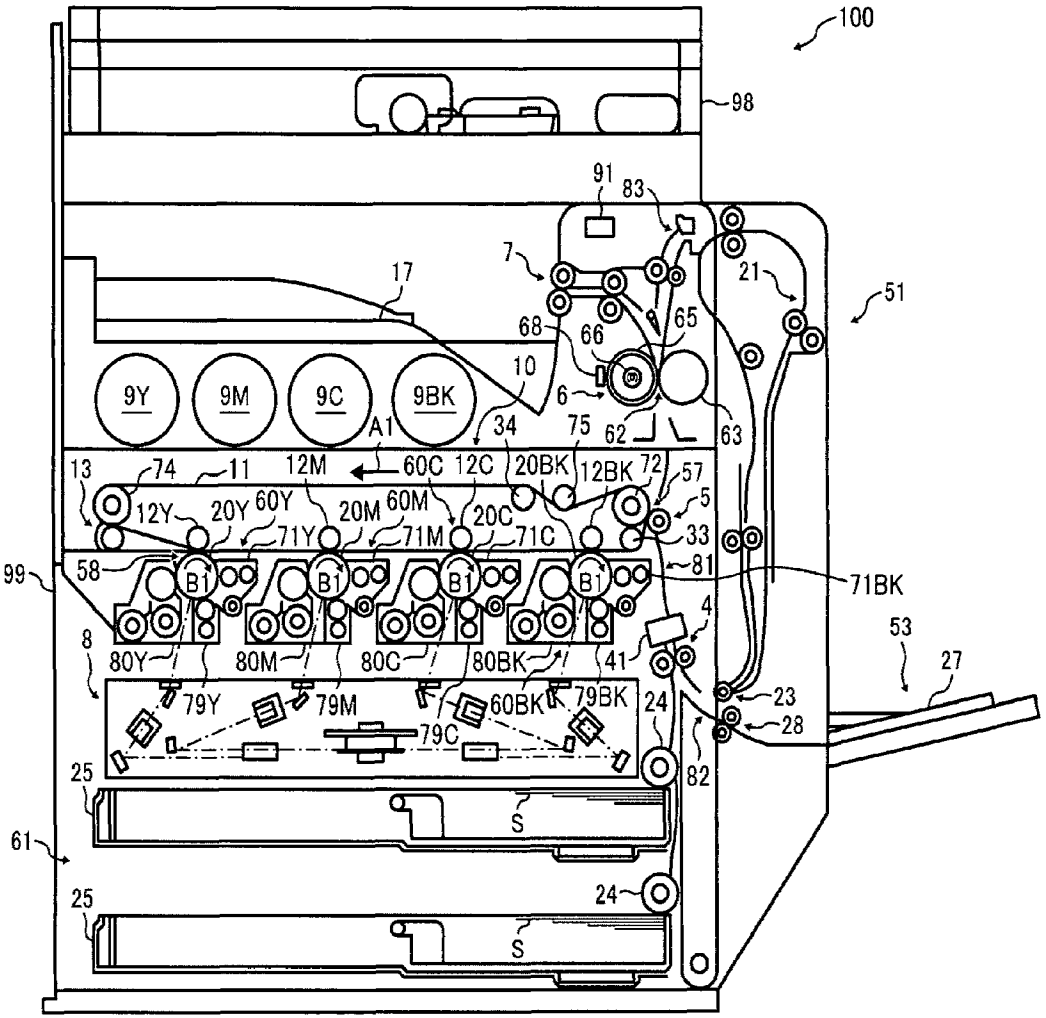
FIG. 1 is a schematic front view illustrating an embodiment of the image forming apparatus of the present invention.

FIG. 1 is a schematic front view illustrating an embodiment of the image forming apparatus of the present invention. An image forming apparatus 100 is a combined machine including a copier, a printer and a facsimile capable of producing full-color images, and may be other image forming apparatuses such as a single monochrome machine, a single copier, a single printer, a single facsimile or other combined machines including a copier, a printer, etc. The image forming apparatus 100 forms an image based on an image signal corresponding to image information received from outside when used as a printer. This is same when used as a facsimile.

The image forming apparatus 100 is capable of forming an image on a plain paper typically used for a copy; thick papers such as an OHP sheet, a card and a post card; and an envelope as sheet-shaped recording media. The image forming apparatus 100 is capable of forming an image on a transfer paper S as a recording medium as well.

The image forming apparatus 100 uses a tandem method of parallely locating photoreceptor drums 20Y, 20M, 20C and 20BK as drum-shaped image bearers forming yellow, magenta, cyan and black images, respectively along a transfer belt 11.

The photoreceptor drums 20Y, 20M, 20C and 20BK are rotatably held by an unillustrated frame of a printer unit 99 of the image forming apparatus 100, and lined in this order from upstream in a travel direction of the transfer belt 11 as an intermediate transfer belt bearing a toner image and an anti-clockwise direction (A1) in FIG. 1. Y, M, C or BK following each number is a member for yellow, magenta, cyan or black.

The photoreceptor drums 20Y, 20M, 20C and 20BK are installed in image forming units 60Y, 60M, 60C and 60BK for forming yellow (Y), magenta (M), cyan (C) and black (BK) images, respectively.

The photoreceptor drums 20Y, 20M, 20C and 20BK are located such that rotational axes thereof are parallel to each other at an outer circumferential surface side, i.e., an image forming side of the endless transfer belt 11 located at the center of the unit 99 at an equally-spaced predetermined pitch in the travel (A1) direction of the transfer belt 11.

The transfer belt 11 is capable of travelling in an arrow A1 direction, facing each of the photoreceptor drums 20Y, 20M, 20C and 20BK.

A visual image, i.e., a toner image formed on each of the photoreceptor drums 20Y, 20M, 20C and 20BK is overlappingly transferred onto the transfer belt 11 travelling in the arrow A1 direction, and then transferred onto a transfer paper S at a time. The image forming apparatus 100 is an image forming apparatus using an intermediate transfer method. Therefore, the image forming apparatus 100 is an image forming apparatus using a tandem-type indirect transfer method.

The lower side of the transfer belt 11 faces each of the photoreceptor drums 20Y, 20M, 20C and 20BK, which forms a first transfer part 58 transferring a toner image on each of the photoreceptor drums 20Y, 20M, 20C and 20BK onto the transfer belt 11 as a first transfer area.

In the process where the transfer belt 11 travels in the A1 direction, each of first transfer rollers 12Y, 12M, 12C and 12BK located facing each of the photoreceptor drums 20Y, 20M, 20C and 20BK through the transfer belt 11 applies a voltage, delaying the timing of voltage application from upstream to downstream side in the A1 direction such that a toner image formed on each of the photoreceptor drums 20Y, 20M, 20C and 20BK is overlappingly transferred onto the same position of the transfer belt 11.

The image forming apparatus 100 includes the image forming units 60Y, 60M, 60C and 60BK, a transfer belt unit 10 as a first transfer unit including the transfer belt 11, a second transferer 5 as a second transfer unit located at a right side of the transfer belt 11, facing belt 11 in FIG. 1, and an optical scanner 8 as an irradiator forming a latent image located below the image forming units 60Y, 60M, 60C and 60BK, facing them in the unit 99.

Below the optical scanner 8, the image forming apparatus 100 includes a sheet feeder 61 capable of loading multiple pieces of the transfer paper S fed to a second transfer part 57 between the transfer belt 11 and the second transferer 5, a pair of registration rollers 4 sending out the transfer paper S fed from the sheet feeder 61 to the second transfer part 57 at a predetermined timing of toner image formation by the image forming units 60Y, 60M, 60C and 60BK, and an unillustrated sensor detecting an end of the transfer paper S reaches the pair of registration rollers 4 as well in the unit 99.

The image forming apparatus 100 includes a roller fixer 6 fixing a toner image transferred onto the transfer paper S thereon, a fixing liquid applicator 41 applying a fixing liquid mentioned later to the transfer paper S sent out to the second transfer part 57 by the pair of registration rollers 4, i.e., the transfer paper before a toner image is transferred thereon at the second transfer part 57, a pair of paper discharge rollers 7 discharging the transfer paper S out of the unit 99, toner bottles 9Y, 9M, 9C and 9BK filled with a yellow, cyan, magenta and black toners, respectively and located above the transfer belt unit 10, and a paper discharge tray 17 formed above in the unit 99, loading the transfer paper S discharged out of the unit 99 by the pair of paper discharge rollers 7 as well in the unit 99.

The image forming apparatus 100 includes a both side unit 51 on the right side surface of the unit 99 and an image reader 98 reading an image at the upper side thereof as well.

The image forming apparatus 100 includes a paper feed path 81 the transfer paper S sent out from the sheet feeder 61 enters, which is formed from the bottom to the top on the right, including the second transferer 5, the pair of registration rollers 4*m* the fixer 6 and the paper discharge roller 7 on the way; a paper feed path 82 jointing with the paper feed path 81 from the both side unit 51 at an upstream side of the pair of registration rollers in a travel direction of the transfer paper S in the paper feed path 81; and a paper refeed path 83 branched from the paper feed path 81 toward the both side unit 51 at a downstream side of the fixer 6 in a travel direction of the transfer paper S in the paper feed path 81 as well in the unit 99.

The image forming apparatus 100 includes an unillustrated driver rotationally driving each of the photoreceptor drums 20Y, 20M, 20C and 20BK; a CPU controlling general operations of the image forming apparatus 100; a controller 91 including a memory; and an unillustrated power source supplying power provided from an outside power source to each configuration of the image forming apparatus 100 as well in the unit 99.

The image forming apparatus 100 includes an unillustrated start switch to start forming images and an unillustrated operation panel including a key to input a thickness of the transfer paper S and an unillustrated liquid crystal indicator to perform a predetermined indication and specifying operations of the image forming apparatus 100 as well on an outer surface of the unit 99.

As FIG. 1 shows, the image forming apparatus 100 internally discharges a paper, in which the paper discharge tray 17 is located above the unit 99 and below the image reader 98.

Besides the transfer belt 11, the transfer belt unit 10 includes the first transfer rollers 12Y, 12M, 12C and 12BK; plural drive rollers 72 driving the transfer belt 11; a cleaning opposed roller 74; suspension rollers 33 and 34 supporting the transfer belt 11 with the drive rollers 72 and the cleaning opposed roller 74; and a tension roller 75 applying a tension to the transfer belt 11 with the cleaning opposed roller 74 while contacting the transfer belt 11 from an outside thereof.

The transfer belt unit 10 includes a cleaner 13 cleaning the surface of the transfer belt 11 at a position opposing the cleaning opposed roller 74, an unillustrated belt driver rotationally drive the drive rollers 72, an unillustrated power source and an unillustrated bias controller applying a first transfer bias to each of the first transfer rollers 12Y, 12M, 12C and 12BK and forming the first transferer therewith as well.

The cleaning opposed roller 74, the suspension rollers 33 and 34, and the tension roller 75 are driven rollers rotating with the transfer belt 11 rotationally driven by the drive rollers 72. The first transfer rollers 12Y, 12M, 12C and 12BK press the backside of the transfer belt 11 toward the photoreceptor drums 20Y, 20M, 20C and 20BK to form first transfer nips, respectively. The first transfer nip is formed at a part of the transfer belt 11 almost horizontally wound by the cleaning opposed roller 74 and the suspension roller 33. The cleaning opposed roller 74, the suspension roller 33, and the tension roller 75 stabilize the first transfer nip.

In each of the first transfer nips, first transfer electric fields are formed between the photoreceptor drums 20Y, 20M, 20C and 20BK and the first transfer rollers 12Y, 12M, 12C and 12BK, respectively. Each color toner image formed on each of the photoreceptor drums 20Y, 20M, 20C and 20BK is first transferred onto the transfer belt 11 by the first transfer electric fields and nip pressures.

The second transferer 5 contacts the drive roller 72 through the transfer belt 11 to form the second transfer part 57.

The cleaning opposed roller 74 has a function of a tension roller as a pressure member applying a predetermined tension to the transfer belt 11 with the tension roller 75.

The cleaner 13 is located left below the transfer belt unit 10, specifically below the cleaning opposed roller 74 in FIG. 1. The cleaner 13 includes a brush roller and a cleaning roller as a cleaning member contacting the transfer belt 11 at a position facing the cleaning opposed roller 74, a case containing the cleaning member, and a waste toner collection bottle on the near side of the case in FIG. 1, which are unillustrated.

The cleaner 13 scrapes and removes foreign particles such as a residual toner on the transfer belt 11 with the cleaning member to clean the transfer belt 11. The foreign particles removed from the transfer belt 11 are stored in the waste toner collection bottle. The waste toner collection bottle is removable to the near side when the front panel is open in FIG. 1, and exchangeable when filled with the foreign particles. Each of cleaners 71Y, 71M, 71C and 71BK mentioned later has an exchangeable waste toner collection bottle.

The second transferer 5 includes an unillustrated second transfer roller facing the drive roller 72 and contacting the transfer belt 11, and a spring as a biasing means biasing the second transfer roller to the transfer belt 11 to form the second transfer part 57 therebetween. A voltage having a polarity reverse to that of a toner is applied by a power source to the second transfer roller to transfer a toner image on the transfer belt 11 onto a transfer paper S not only by the contact pressure to the transfer belt 11 with the spring but also by a bias. The second transfer roller has a sheet feeding function feeding the transfer paper S a toner image transferred onto to the fixer 6. The spring contacts a transfer paper S fed in the second transfer part 57 closely to the transfer belt 11 and transfer a toner image thereon onto a surface coated with a fixing liquid by the fixing liquid applicator 41 of the transfer paper S.

The optical scanner 8 includes a light source such as laser diodes, a polygon mirror, an F-θ lens, a reflection mirror, etc. Based on data corresponding to an image to be formed, the controller 91 controls the light source to emit light and the polygon mirror to rotate to emit a laser beam to the surface of each of the photoreceptor drums 20Y, 20M, 20C and 20BK while scanning the surface to form an electrostatic latent image for each color of yellow, magenta, cyan and black.

The sheet feeder 61 contains a bundle of plural transfer papers S, and is located at the bottom of the unit 99 and below the optical scanner 8. The sheet feeder 61 includes plural (two in this embodiment) vertically-piled two-stage paper feed cassettes 25 capable of containing bundles of plural transfer papers S, a paper feed roller 24 contacting an upper surface of the uppermost transfer paper S loaded in each of the paper feed cassettes 25, an unillustrated separation roller separating one sheet of the transfer papers S fed by the paper feed roller 24 and further feeding the sheet, and an unillustrated detector detecting whether the paper feed cassettes 25 is open. The paper feed roller 24 is rotated anti-clockwise at a predetermined timing to feed the uppermost transfer paper S to the pair of registration rollers 4.

The sheet feeder 61 feeds the uppermost transfer paper S loaded in the paper feed cassettes 25 to the pair of registration rollers 4 through the paper feed path 81 when the paper feed roller 24 is rotated anti-clockwise and the separation roller works. The transfer paper S runs into the pair of registration rollers 4 and stops therebetween.

The both side unit 51 includes a manual paper feeder 53 located on the outside surface, a part of the paper feed path 82 located across the both side unit 51 from the manual paper feeder 53, a reverse feed path 21 reversing the transfer paper S having passed the paper refeed path 83 to the paper feed path 82, and a feed roller 23 located in the reverse feed path 21, feeding the transfer paper S to the paper feed path 82.

The manual paper feeder 53 includes a manual tray 27 capable of loading a transfer paper S, a paper feed roller 28 contacting the upper surface of the uppermost transfer paper S loaded on the manual tray 27, a separation roller separating one by one of the transfer papers sent out by the paper feed roller 28.

The manual paper feeder 53 feeds the uppermost transfer paper S to the pair of registration rollers 4 when the paper feed roller 28 is rotated clockwise and the separation roller works. The transfer paper S runs into the pair of registration rollers 4 and stops therebetween.

The fixing device 6 includes a fixing roller 65 as a roller-shaped fixing member, a roller-shaped pressure roller 63 contacting the fixing roller 65 with pressure to form a fixing nip 62 pressing a transfer paper S, a halogen heater 66 as a fixing heat source, located in the fixing roller 65, heating the fixing roller 65 to heat the fixing nip 62 to have a predetermined temperature, and a non-contact thermistor 68 located closely to an outer circumference of the fixing roller 65, detecting a temperature thereof as a fixing member temperature detector.

Figure 2:
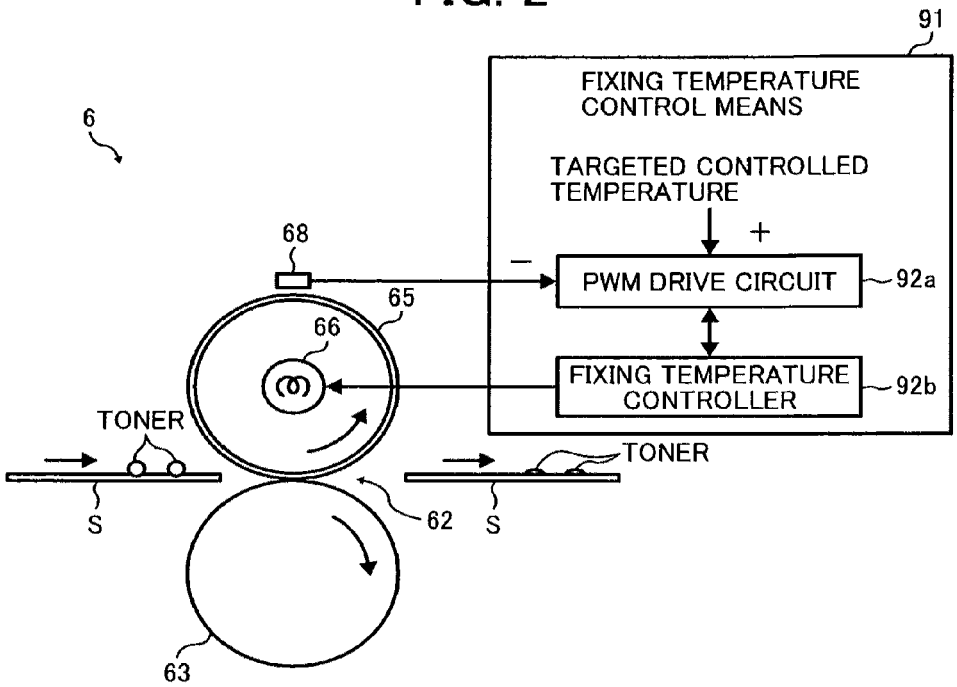
FIG. 2 is a block diagram of a part of a control system controlling a fixing device in FIG. 1.

As FIG. 2 shows, the fixing device 6 includes a PWM drive circuit 92*a* as a heating driver driving the heater 66, and a fixing temperature controller 92*b* controlling a temperature of the fixing roller 65 by controlling a power applied to the heater 66 with a current time per unit time (=DUTY) through the PWM drive circuit 92*a* based on information of a temperature deviation between a targeted temperature of the fixing roller 65 mentioned later and a temperature thereof detected by the thermistor 68 as well.

The PWM drive circuit 92*a* and the fixing temperature controller 92*b* are one of functions of the controller 91. In this respect, the controller 91 works as a fixing temperature controller. The controller 91 working as a fixing temperature controller controls a temperature of the fixing roller 65 to substantially control a temperature of the fixing nip 62.

The fixing device 6 passes a transfer paper S bearing a toner image while sandwiched through the fixing nip 62, the fixing roller 65 contacts the image surface of the transfer paper S bearing a toner image to melt a toner forming the toner image heat with and bond the toner image on the surface of the transfer paper S with pressure.

The transfer paper S entering the fixing nip 62 is applied with a fixing liquid by the fixing liquid applicator 41 on the surface bearing a toner, but the fixing liquid is not illustrated.

The other functions of the fixing device 6 are mentioned later.

Each yellow, cyan, magenta and black color toner in the toner bottles 9Y, 9M, 9C and 9BK is a polymerization toner and rotated by an unillustrated driver to be discharged. A predetermined amount of the toner is fed to each of image developers 80Y, 80M, 80C and 80BK of the image forming units 60Y, 60M, 60C and 60BK.

The image reader 98 includes a contact glass an original is placed on, a light source emitting light to the original on the contact glass, a first reflector reflecting reflected light from the original, a first runner running in a horizontal direction in FIG. 1, a second runner including a second reflector reflecting reflected light from a reflector of the first runner, an imaging lens imaging light from the second runner, and a reading sensor receiving light through the image lens to read the original.

The image forming units 60Y, 60M, 60C and 60BK have the same configuration each other. The image forming units 60Y, 60M, 60C and 60BK include around the photoreceptor drums 20Y, 20M, 20C and 20BK, along a clockwise direction B1 in FIG. 1, the first transfer rollers 12Y, 12M, 12C and 12BK as process means, the cleaners 71Y, 71M, 71C and 71BK as cleaning means, unillustrated dischargers as discharging means, charges 79Y, 79M, 79C, 79BK including unillustrated charging rollers as AC charging means, an the image developers 80Y, 80M, 80C and 80BK each developing with a two-component developer including a toner and a carrier as developing means, respectively.

These are known configurations, and each of the image developers 80Y, 80M, 80C and 80BK includes a developing roller facing each of the photoreceptor drums 20Y, 20M, 20C and 20BK as a developer bearer, a screw stirring a developer while feeding the developer, a toner concentration sensor detecting a toner concentration in a developer, and a toner feeder feeding a toner in the toner bottles 9Y, 9M, 9C and 9BK into the apparatus according to the toner concentration as a toner feeding means. The developing roller includes a magnet fixed on the apparatus and a sleeve rotatably held at the outer side of the magnet.

The photoreceptor drum 20Y, the cleaner 71Y, the discharger, the charger 79Y, and the image developer 80Y are combined as a process cartridge. The configurations around each of the photoreceptor drums 20Y, 20M, 20C and 20BK are combined to form the process cartridge as well. The process cartridge is detachable in a rotational axial direction of each of the photoreceptor drums 20Y, 20M, 20C and 20BK at the near side in FIG. 1 when the front panel is opened. The process cartridge is handled as an exchangeable part and noticeably improves maintainability.

In the image forming apparatus 100, when a start switch is pushed, each of the image forming units 60Y, 60M, 60C and 60BK performs the following image forming process. Namely, when a signal to form a color image enters, the image reader 98 reads an original and data corresponding to an image to be formed are obtained and enter the controller 91. The drive roller 72 drives, and the transfer belt 11, the cleaning opposed roller 74, the suspension rollers 33 and 34, and the tension roller 75 is driven to rotate, and the photoreceptor drums 20Y, 20M, 20C and 20BK are rotated in the B1 direction.

The surface of each of the photoreceptor drums 20Y, 20M, 20C and 20BK is uniformly charged by the charging roller of each of the chargers 79Y, 79M, 79C and 79BK having received an electric power from an electric source while rotating in the B1 direction. Laser beam scanning from the optical scanner 8 driven by the controller 91 based on the data corresponding to an image to be formed forms an electrostatic latent image of each color of yellow, magenta, cyan and black on each of the photoreceptor drums 20Y, 20M, 20C and 20BK. The electrostatic latent image is developed by the image developers 80Y, 80M, 80C and 80BK with each color toner of yellow, magenta, cyan and black to visualize and monochrome images of each color toner image of yellow, magenta, cyan and black are formed.

The color toner images of yellow, magenta, cyan and black are sequentially transferred by the transfer rollers 12Y, 12M, 12C and 12BK each applied by an electric source with a voltage having a polarity reverse to that of the toner onto the same position on the transfer belt 11 to form a synthesized color image thereon.

When a signal to form a color image enters, the paper feed roller 24 of the paper feed cassettes 25 or the paper feed roller 28 of the manual tray 27 is selectively driven to rotate, and sends out a transfer paper S and separates one by one. The transfer paper S sent out runs into the pair of registration rollers 4 and stops. When images are formed on both sides, a transfer paper S, one of the side of which an image is fixed on by the fixing device 6, passes through the reverse feed path 21 to be reversed and runs into the pair of registration rollers 4 to be stopped.

Synchronizing traveling of the synthesized color image overlapped on the transfer belt 11 to the second transfer part 57 with the rotation of the transfer belt 11 in the A1 direction, the pair of registration rollers 4 rotate to send out the transfer paper S to the second transfer part 57 where the surface thereof the synthesized color toner image is transferred onto is applied with a fixing liquid by the fixing liquid applicator 41.

The second transfer roller biased to the transfer belt 11 closely contacts the synthesized color image to the transfer paper S applied with a fixing liquid at the second transfer part 57. The synthesized color image is secondly transferred onto the transfer paper S with a nip pressure and a voltage having a polarity reverse to that of the toner forming the synthesized color image, and recorded thereon.

The transfer paper S is transferred by the second transferer 5 and the transfer belt 11 rotating in the A1 direction to the fixing device 6. When the transfer paper S passes the fixing nip 62 between the fixing roller 65 and the pressure roller 63 in the fixing device 6, the toner image, i.e., the synthesized color image is fixed on the transfer paper S with heat, pressure and the fixing liquid mentioned later.

The transfer paper S the synthesized color image is fixed on having passed the fixing device 6 is discharged out of the unit 99 through the pair of paper discharge rollers 7 and stacked on the paper discharge tray 17 above in the unit 99. When images are formed on both sides, the transfer paper S, one of the side of which an image is fixed on by the fixing device 6, passes through the reverse feed path 21 to be reversed and runs into the pair of registration rollers 4 to be stopped.

Untransferred toner remaining on each of the photoreceptor drums 20Y, 20M, 20C and 20BK is removed by the cleaners 71Y, 71M, 71C and 71BK, and the photoreceptor drums are discharged by the dischargers and are ready to be charged by the chargers 79Y, 79M, 79C and 79BK.

The surface of the transfer belt 11 having passed the second transfer part 57 after the second transfer is cleaned by the cleaning member of the cleaner 13 and is ready for a following transfer.

The fixing liquid is explained.

The fixing liquid includes a plasticizer swelling and softening a toner forming a toner image transferred onto a transfer paper S at the second transfer part 57 to be suitable for transferring onto the transfer paper S, a surfactant improving permeability of the fixing liquid among the toners, and a solvent as a diluted solution including the plasticizer and the surfactant.

The plasticizer is a solid plasticizer softening when heated. In the image forming apparatus 100, when heated by the fixing device 6, i.e., when higher than 40 to 50° C. which is a typical operating temperatures when the image forming apparatus 100 is used. The operating temperatures is, e.g., a temperature in an office or a temperature except for an atmospheric temperature around the fixing device being heated in the unit 99.

Therefore, even when the plasticizer adheres to the other configurations of the image forming apparatus 100 except for the fixing device 6 such as the transfer belt 11 and the second transfer roller at the second transfer part 57, troubles due to the adherence are prevented or inhibited.

However, when heated by the fixing device 6 at a temperature higher than the operating temperatures, the plasticizer swells and softens a toner to be suitable for transferring onto the transfer paper S. This is explained, using FIG. 3.

Figure 3:
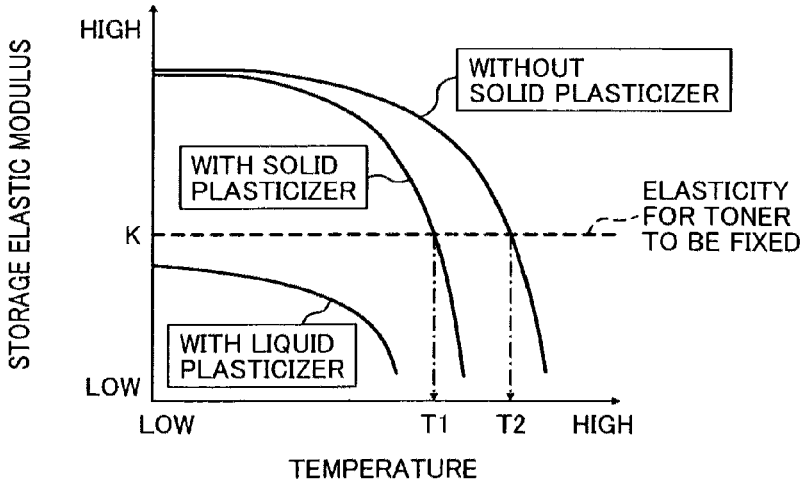
FIG. 3 is a conceptual diagram showing a plasticizer swelling and softening a toner when heated lowers a minimum fixable temperature thereof.

FIG. 3 is a basic concept showing the fixable minimum temperature of a toner lowers with a plasticizer within the temperatures at which the toner becomes suitable for being fixed. In FIG. 3, the storage elastic modulus is a value of hardness of a toner. The higher, the harder. The lower, the softer. When the storage elastic modulus is K or less, the toner is fixable on the transfer paper S. Therefore, a temperature when the storage elastic modulus is K is the fixable minimum temperature. In FIG. 3, a solid plasticizer is a plasticizer used in a fixing liquid for use in the image forming apparatus 100. The plasticizer is a solid when alone in the operating temperatures before included in the fixing liquid. Further, in FIG. 3, the liquid plasticizer is a liquid when alone in the operating temperatures.

As FIG. 3 shows, a fixing liquid including a plasticizer is applied to a toner, the toner has a fixable minimum temperature T1 lower than a fixable minimum temperature T2 without the fixing liquid. Therefore, a targeted controlled temperature of the fixing roller 65 can be set lower than the temperature without the fixing liquid, and the fixing device 6 and the image forming apparatus 100 can reduce power consumption.

FIG. 3 also shows the liquid plasticizer is capable of softening a toner at temperatures lower than T1, e.g., at normal temperature included in the operating temperatures. Further, it shows a fixing liquid including a solid plasticizer does not work at a temperature at which the liquid plasticizer is capable of softening a toner and is a fixing liquid including the liquid plasticizer, and scarcely has softening capability at the operating temperatures. Therefore, the image forming apparatus 100 has inner contamination when using a fixing liquid including a liquid plasticizer, but has no inner contamination when using a fixing liquid including a solid plasticizer. Whether a plasticizer capable of lowering the storage elastic modulus of a toner is a solid or a liquid at operating temperatures such as normal temperature when alone is one of guidelines whether the plasticizer in a fixing liquid causes the inner contamination, and therefore that the plasticizer in the fixing liquid for use in the image forming apparatus 100 is a solid at operating temperatures when alone is one of selection standards.

The solid plasticizer is a compound including an ethyleneoxide group —($CH_2CH_2O$)— or a propyleneoxide group —($CH(CH_3)CH_2O$)— in its molecular chain, and typically glycolethers and glycol fatty acid esters which are solids at normal temperature, preferably having melting point not less than 40° C., and more preferably not less than 50° C.

Specifically, polyoxyethyleneglycols having the following formula (1) are preferably used.

$$HO—(CH_2CH_2O)n\text{-}OH \quad (1)$$

n is preferably from 10 to 100. When n is less than 10, this is not solidified at room temperature. When n is greater than 100, its molecule is so large that the plasticizing capability is low when heated, and a toner is difficult to soften. Specific examples of the materials include polyethyleneglycol #1000, polyethyleneglycol #1540, polyethyleneglycol #2000, polyethyleneglycol #4000, polyethyleneglycol #6000, polyethyleneglycol #8000, etc.

In addition, polyoxyethylenepolyoxypropyleneglycols having the following formula (2) are preferably used as well.

$$HO—(CH_2CH_2O)n(CH(CH_3)CH_2O)m\text{-}OH \quad (2)$$

n is preferably from 10 to 200. m is preferably from 5 to 50. When n is less than 10, this is not solidified at room temperature. When n is greater than 200, its molecule is so large that the plasticizing capability is low when heated, and a toner is difficult to soften. When m is less than 5, this is not solidified at room temperature. When m is greater than 50, its molecule is so large that the plasticizing capability is low when heated, and a toner is difficult to soften. Specific examples of the materials include EMULGEN 290 from Kao Corp.; and Epan 450, Eapn 750 and Epan 785 from DAI-ICHI KOGYO SEIYAKU CO., LTD., etc.

Further, polyoxyethylenealkylethers having the following formula (3) are preferably used as well.

$$R—O—(CH_2CH_2O)n\text{-}OH \quad (3)$$

n is preferably from 10 to 100. When n is less than 10, this is not solidified at room temperature. When n is greater than 100, its molecule is so large that the plasticizing capability is low when heated, and a toner is difficult to soften.

R is preferably a direct-chain alkyl group or a branched-chain alkyl group having 10 to 22 carbon atoms. When the number of the carbon atoms is less than 10, this is too soft as a solid and has safety problems such as skin and eye irritancy. When greater than 22, its plasticizing capability is low when heated, and a toner is difficult to soften. Specific examples of the materials include EMULGEN 350, EMULGEN 420, EMULGEN 4085 from Kao Corp.; and EMALEX 611, EMALEX 620, EMALEX 710 and EMALEX 720 from Nihon Emulsion Co., Ltd., etc.

In addition, polyoxyethylene fatty acid esters having the following formula (4) and polyoxyethylene fatty acid diesters having the following formula (5) are preferably used as well.

$$R—COO—(CH_2CH_2O)n\text{-}OH \quad (4)$$

$$R—COO—(CH_2CH_2O)n\text{-}COO—R' \quad (5)$$

n is preferably from 10 to 100. When n is less than 10, this is not solidified at room temperature. When n is greater than 100, its molecule is so large that the plasticizing capability is low when heated, and a toner is difficult to soften. Each of R an R' is preferably a normal-type alkyl group or a branched-chain alkyl group having 10 to 22 carbon atoms. When the number of the carbon atoms is less than 10, this is too soft as a solid and has safety problems such as skin and eye irritancy. When greater than 22, its plasticizing capability is low when heated, and a toner is difficult to soften. Specific examples of the materials include EMANON 3199V and EMANON 3299RV from Kao Corp.; and EMALEX 820 and EMALEX 830 from Nihon Emulsion Co., Ltd., etc.

The surfactant is used to improve permeability of the fixing liquid into a toner layer. Nonionic surfactants such as polyoxyethylenealkylethers and acetylene surfactants are preferably used. Specific examples of the polyoxyethylenealkylethers include polyoxyethylenelaurylether, polyoxyethylenealkyl(12-14)ether(12E.O.) and polyoxyethylenealkyl(12-14)ether such as BT-12 from Nikko Chemicals Co., Ltd. Specific examples of the acetylene surfactants include acetylene glycol such as OLFINE 1010 and OLFINE 4051F from Nissin Chemical Industry Co., Ltd.

Water is preferably used as a diluted solution which is a solvent for these materials. Tap water includes many impurities such as calcium ions and magnesium ions, and therefore it is preferable to remove these metallic ions to some extent from the tap water to use. Distilled water is not needed, and water impurities are removed from thorough an ion exchange film, i.e., ion-exchanged water is preferably used.

A heating temperature for fixing the toner image on the transfer paper S coated with the fixing liquid including the solid plasticizer, i.e., the targeted controlled temperature of the fixing roller 65 is explained.

As having been explained, the fixing liquid lowers the fixable minimum temperature, and which is typically a temperature assuring a predetermined smear resistance. The smear resistance is a reference on toner contamination when a recording medium after a toner image is fixed on is scraped. The lower the density of the toner contamination, the less the toner contamination and the better the fixability. When a smear ID mentioned later is 0.40 or less, practically allowable. Therefore, the targeted controlled temperature of the fixing roller 65 is a temperature when the storage elastic modulus is K or less and the smear ID is 0.40 or less.

Figure 4:
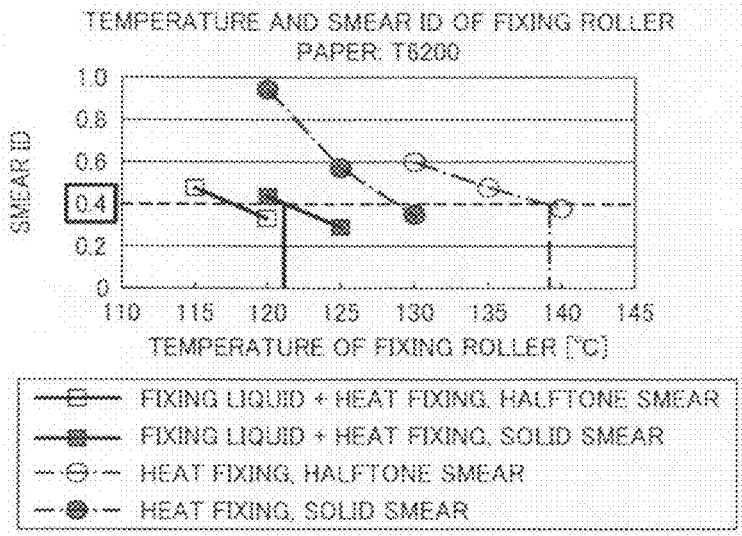
FIG. 4 is a conceptual diagram showing a plasticizer swelling and softening a toner when heated improves smear resistance.

As FIG. 4 shows, the image forming apparatus 100 improves in smear resistance at a same temperature, compared with an image forming apparatus including only a heating fixing device without using a fixing liquid. FIG. 4 shows a comparison of smear test results between the image forming apparatus 100 in which a fixing liquid is applied to a transfer paper S before a toner image is transferred onto and an image forming apparatus including only a heating fixing device. The fixing liquid includes polyethyleneglycol #2000 as a solid plasticizer in an amount of 25% by weight, OLFINE 4051F as a surfactant in an amount of 0.5% by weight, and ion-exchanged water as a solvent. The smear test is performed with a smear tester including a friction tester I JIS-L0823 and frictioner diameter of 15Φ. A 25 mm×25 mm white cotton cloth (JIS L0803 Cotton No. 3) is attached to the frictioner with a double-face adhesive tape such that a fiber direction of the cotton is horizontal to a movable direction of the frictioner. A halftone image having an image area of 55% and a solid image having an image area of 100% are scraped with the frictioner back and forth for five times. Image densities of random three parts of the image the frictioner scraped are measured by a spectrometer (938 spectrodensitometer from X-Rite, Inc.) and an average thereof is the smear ID. As mentioned above, the lower the smear ID, the less the toner contamination when a fixed image is scraped. When a smear ID mentioned later is 0.40 or less, practically allowable. Therefore, the image forming apparatus 100 has smear resistance even when the targeted controlled temperature of the fixing roller 65 is 121° C., but the image forming apparatus including only a heating fixing device does not have smear resistance unless the targeted controlled temperature is 139° C.

The targeted controlled temperature of the fixing roller 65 of 121° C. is lower than that of the image forming apparatus including only a heating fixing device by 18° C., and therefore the image forming apparatus 100 saves more power than the image forming apparatus including only a heating fixing device and reduces environmental burdens. In this embodiment, the fixing liquid including polyethyleneglycol #2000 as a solid plasticizer in an amount of 25% by weight and OLFINE 4051F as a surfactant in an amount of 0.5% by weight is used as mentioned above, but a temperature for obtaining smear resistance is changeable by controlling a concentration of the plasticizer, and the targeted controlled temperature is not limited thereto.

The image forming apparatus 100 cannot form an image having good smear resistance at such a low fixing temperature simply because of using a fixing liquid including a solid plasticizer, but because the fixing liquid is applied to a transfer paper S before bearing a toner image, the toner image on the transfer belt 11 is transferred onto the liquid-coated surface of the transfer paper S by the second transferer 5 while the toner image is contacted thereto, and the fixing device 6 fixes the toner image thereon with heat. The reason is explained.

Figure 5:
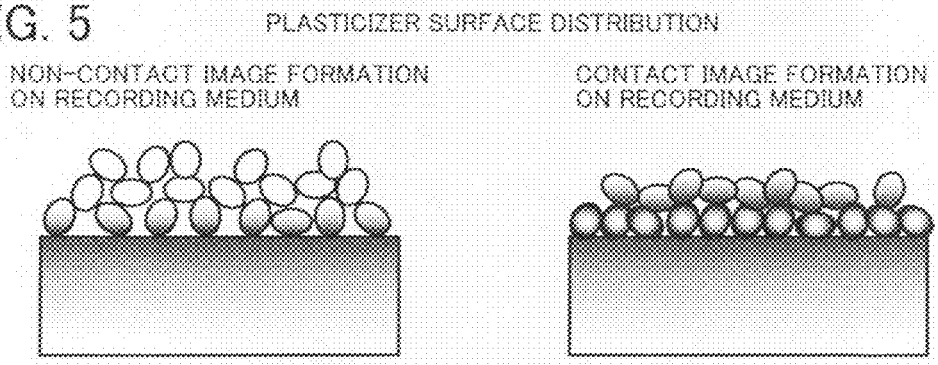
FIG. 5 is a conceptual diagram showing that the fixing liquid differently adheres to a toner when transferred onto a recording medium while contacted and not contacted thereto.

First, when a toner image on the transfer belt 11 is transferred onto a transfer paper S while the toner image is contacted thereto, a fixing liquid applied to the transfer paper S capillarily penetrates between a multitude of toners forming the toner image as FIG. 5 shows, the surface of even each toner contacting the transfer belt 11 is covered by the fixing liquid. Particularly, the fixing liquid adheres to the toners close to the transfer paper S much. The capillarity becomes stronger when the toner image on the transfer belt 11 is transferred onto the transfer paper S while the toner image is contacted thereto, and the penetration of the fixing liquid between the toners is more promoted than simply transferring a toner image electrostatically from the transfer belt 11 onto the transfer paper S. The capillarity becomes stronger still when the toner image is transferred while the transfer paper S is contacted to the transfer belt 11 with pressure, and the penetration goes well.

Figure 6:
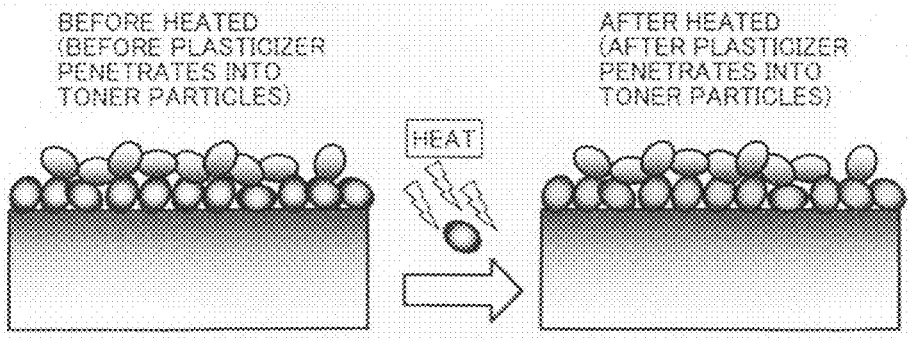
FIG. 6 is a conceptual diagram showing that the fixing liquid swells and softens a toner when heated when the toner is transferred onto a recording medium while contacted.

Next, when the transfer paper S bearing a toner image in which the fixing liquid penetrates between the toners and the surfaces thereof are covered therewith is heat at the fixing nip 62, a plasticizer in the fixing liquid is heated with the toner and penetrates into a resin in the toner to swell and soften the toner as FIG. 6 shows. A pressure is applied as well at the fixing nip, and the penetration of the fixing liquid into a toner layer is more promoted. The softened toner effectively exerts an anchor effect to the transfer paper S and is fixed thereon. When the toner image is heated from its surface, a heat is difficult to transfer to an interface between the transfer paper S and the toner image. However, as mentioned above, the fixing liquid adheres well to the toner close to the surface of the transfer paper S, and the plasticizer exerts the above-mentioned function when heated to have a temperature at which it does and the toner image is efficiently fixed. Particularly, in this embodiment, the toner image is heated from its surface and the transfer paper S less absorbs heat than heated only from the backside thereof. Therefore, the plasticizer is more efficiently heated to quickly exert its function. The pressure roller 63 may be heated to heat from the backside of the transfer paper S as well, as long as power consumption is sufficiently saved.

In the image forming apparatus 100, a fixing liquid fulfilling its function at a temperature lower than a conventional fixable temperature is applied to a transfer paper S, the fixing liquid efficiently adheres to a toner on the surface of the transfer paper S when a toner image is transferred thereto while contacting thereto. Therefore, particularly the toner on the surface of the transfer paper S is softened to fix well at a temperature lower than a conventional temperature, i.e., with less heat quantity. An amount of the fixing liquid applied to the transfer paper S efficiently adhering to a toner on the surface of the transfer paper S when a toner image is transferred thereto while contacting thereto is less than an amount thereof when the fixing liquid is fed from the surface of a toner image, and an electric power and a time needed to dry the fixing liquid can be reduced. The contact transfer uses capillarity and an amount of the fixing liquid applied to the transfer paper S is less than an amount thereof when a toner is transferred thereto flying, which can reduce the electric power and the time needed to dry the fixing liquid as well.

In addition, the fixing liquid is applied before a toner image is transferred, the toner image is not distorted when the fixing liquid is applied. Further, the fixing liquid works when heated to fix a toner image, and does not have negative influence even when adhering to the transfer belt 11. This is not limited to liquid development.

The fixing liquid having the form of a liquid and not a foam can avoid deterioration of transferability due to a space.

Inner contamination due to adherence of the fixing liquid to the photoreceptor drums 20Y, 20M, 20C and 20BK, the transfer belt 11, and further, members contacting thereto can be prevented because the fixing liquid is not applied to the photoreceptor drums 20Y, 20M, 20C and 20BK, the transfer belt 11.

Figure 7:
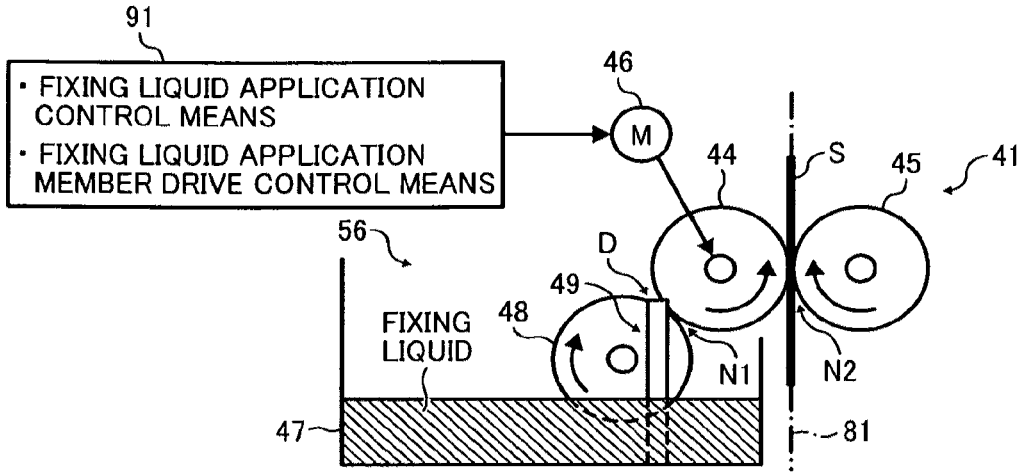
FIG. 7 is a schematic view illustrating a fixing liquid applicator and a part of a control system controlling the applicator in FIG. 1.
Figure 8:
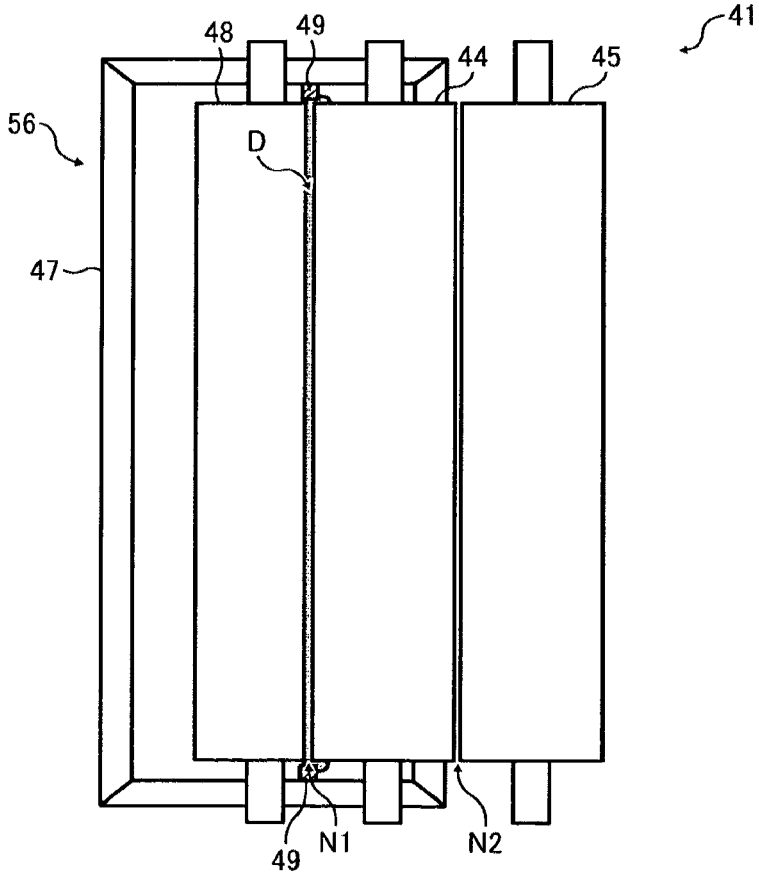
FIG. 8 is a schematic plane view illustrating the fixing liquid applicator in FIG. 7.

The fixing liquid applicator 41 is explained, referring to FIGS. 7 and 8.

The fixing liquid applicator 41 includes an application roller 44 applying the fixing liquid to a transfer paper S fed in the paper feed path 81, a facing roller 45 facing the application roller 44 through the paper feed path 81, a motor 46 rotationally driving the application roller 44 as a driver, and a liquid room 47 containing the fixing liquid as a fixing liquid container.

The fixing liquid applicator 41 includes a feed roller 48 dipped in the fixing liquid contained in the liquid room 47, driven to rotate by the application roller 44, bearing the fixing liquid and feeding the fixing liquid to the application roller 44; a pair of fixing liquid induction members 49 for guiding a part of the fixing liquid passing from the feed roller 48 to the application roller 44 downward to escape, facing each other, located at the ends of the application roller 44 and the feed roller 48; and an unillustrated driver of the motor 46 as well.

The application roller 44, the facing roller 45 and the feed roller 48 are long in a direction perpendicular to the drawing in FIG. 7 and vertically long in FIG. 8. This is a longitudinal direction, and the rollers are parallely located at the same position, having the same length in the longitudinal direction. The application roller 44, the facing roller 45 and the feed roller 48 have longitudinal directions corresponding to horizontal direction when the image forming apparatus 100 is normally set, i.e., FIG. 1 is vertically directed.

The application roller 44 is located at a side of the second transfer part 57, where a toner image is transferred onto a transfer paper S, in the paper feed path 81, and applies a fixing liquid borne on its circumferential surface to the same side surface of the transfer paper S.

The facing roller 45 is driven by the application roller 44 or a transfer paper S fed by the rotation of the application roller 44 to rotate. The facing roller 45 is a glass beads roller having a diameter of 25 mm, formed of a stainless core metal chloroprene is winded around and glass beads having a diameter of 100 μm fixed by an epoxy adhesive on its surface.

The application roller 44 and the feed roller 48 both have a diameter of 25 mm, and each of them is formed of a stainless core metal chloroprene is winded around. Each of the rollers has a hardness of 35° by JIS-A. The application roller 44 and the feed roller 48 apply a pressure of 20N to each other at both ends thereof in a vertical direction in FIG. 8, i.e., in a longitudinal direction.

The centers of the application roller 44 and the facing roller 45 are located at a same height each other. The feed roller 48 has its center at a position 10 mm lower than the center of the application roller 44. The feed roller 48 is dipped in a fixing liquid in the liquid room 47 at a depth of 5 mm. Since the center of the application roller 44 and that of the feed roller 48 are offset, a pressure between the application roller 44 and the feed roller 48 is reduced when a transfer paper S enters a nip between the application roller 44 and the facing roller 45.

The application roller 44 is driven to rotate along a predetermined direction, specifically an arrow direction in FIG. 7, i.e., a feed direction of a transfer paper S in the paper feed path 81 when the motor 46 is driven by the controller 91 through the driver. The controller 91 works as both a fixing liquid application control means controlling application of a fixing liquid on a transfer paper S with the fixing liquid applicator 41 and a fixing liquid application member drive control means controlling application of a fixing liquid on a transfer paper S with the application roller 44.

The application roller 44 and the feed roller 48 both rotate in a direction downward from a contact point, in other words, a nip N1 therebetween. When the application roller 44 and the feed roller 48 thus rotate, a fixing liquid passes from the feed roller 48 to the application roller 44. An amount of the fixing liquid passing the nip N1 to a nip N2 between the application roller 44 and the facing roller 45 to be applied to a transfer paper S is controlled to be a proper quantity with a contact pressure between the application roller 44 and the feed roller 48.

When an amount of the fixing liquid scooped by the feed roller 48 from the liquid room 47 up to the nip N1 is larger than an amount thereof passing the nip N1, a difference between the amounts remains as an extra fixing liquid in a sphenic space above the nip N1 between the application roller 44 and the feed roller 48. The fixing liquid remaining therein is passed to the application roller 44 at the nip N1 and the space.

An amount of the fixing liquid fed to the nip N1 by the feed roller 48 is larger than that thereof passing the nip N1 such that the fixing liquid is constantly applied to a transfer paper S, and a fixing liquid puddle is formed in the space. Therefore, the fixing liquid is passed from the feed roller 48 to the application roller 44 at the nip N1 and the sphenic space above the nip N1. The nip N1 and the sphenic space above the nip N1 form a delivery part D where the fixing liquid is passed from the feed roller 48 to the application roller 44.

When the liquid puddle is formed, the liquid comes around as mentioned above. The fixing liquid in the liquid puddle flows out from the end of the application roller 44 and adheres to the end surface thereof. With rotation of the application roller 44, the fixing liquid reaches the nip N2 and adheres to a transfer paper S, and an amount of the fixing liquid adhering to the transfer paper S increases at a position corresponding to the end of the application roller 44. In a longitudinal direction, an amount of the fixing liquid in the position is larger than that thereof in other positions, resulting in uneven amount thereof. Therefore, an amount of the fixing liquid adhering to the transfer paper S at a position corresponding to the end of the application roller 44 is larger than that thereof applied to the transfer paper S, which is controlled as above, resulting in end contamination.

To prevent this, the fixing liquid induction member 49 induces a part of the fixing liquid passed from the feed roller 48 to the application roller 44. i.e., an extra fixing liquid retained at the delivery part D downward to escape out thereof.

Figure 9:
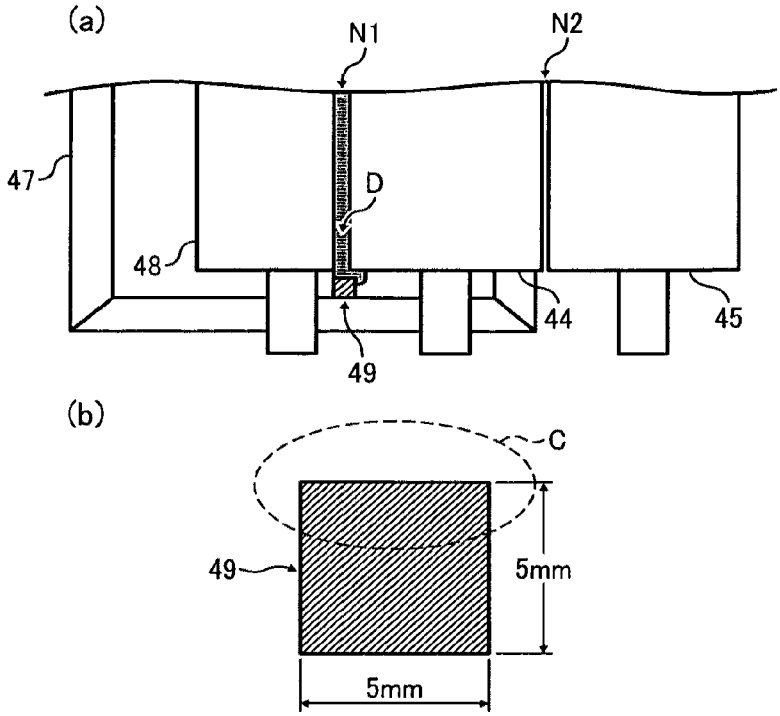
FIGS. 9*a* and 9*b* is an enlarged schematic plane view illustrating a fixing liquid inducing member of the fixing liquid applicator in FIG. 7.

As FIG. 7 or 9 shows, the fixing liquid induction member 49 is a rod-shaped member, and a corner of the top end thereof is located close to the delivery part D in longitudinal directions of the application roller 44 and the feed roller 48. The bottom end of the fixing liquid induction member 49 is fixed on the inner side surface of the liquid room 47 so as to be dipped in the fixing liquid therein. An extensional direction of the fixing liquid induction member 49 is identical to a vertical direction of the image forming apparatus 100 normally set.

The shape and location of the fixing liquid induction member 49 are more specifically explained.

The fixing liquid induction member 49 has a length of 35 mm in the extensional direction and is a member made of POM having the shape of a quadrangular prism having a cross-section perpendicular to the extensional direction of 5 mm×5 mm. The side surface of the bottom end thereof is fixed on the inner surface of the liquid room 47, and the other side thereof faces the ends of the application roller 44 and the feed roller 48 at the delivery part D at a close distance of 0.5 mm. A circled corner C of the fixing liquid induction member 49 in FIG. 9, extending in a vertical direction at the end surface sides of the application roller 44 and the feed roller 48 induces the fixing liquid from the top to the bottom.

Therefore, the fixing liquid induction member 49 contacts the corner C at the top end at least one of an extra fixing liquid retained at the delivery part D and another extra fixing liquid flowing out from the side thereof in a longitudinal direction besides a fixing liquid fed from the nip N1 to the nip N2 by the application roller 44 out of a fixing liquid fed to the nip N1 fed thereby. The extra liquid is transmitted through the corner C due to its weight and surface tension and induced downward out of the delivery part D and returned into the liquid room 47.

Thus, coming around that a fixing liquid having flown out of the delivery part D adheres to the end surface of the application roller 44 and reaches the nip N2 is reduced, and end contamination is prevented and the fixing liquid is uniformly applied to the transfer paper S in a longitudinal direction. Further, the fixing liquid induced by the fixing liquid induction member 49 and flown into the liquid room 47 is ready to be fed again to the nip N1 by the feed roller 48. Unless the fixing liquid is fed to the nip N2 and consumed, the fixing liquid is cycled between the liquid room 47 and the delivery part D and used with high efficiency. The fixing liquid induction member 49 works as a fixing liquid cycle member as well.

Since the fixing liquid induction member 49 does not contact the application roller 44 and the feed roller 48, there is no friction between the fixing liquid induction member 49 and the application roller 44, no increase of rotation torque thereof and power consumption caused thereby, and no viscosity variation of the fixing liquid caused by the friction heat.

The controller 91 working as a fixing liquid application member drive control means drives the motor 46 to rotate the application roller 44 such that the fixing liquid is applied to a transfer paper S fed from the pair of registration rollers 4 to the second transfer part 57 at the time of passing the nip N2. The controller 91 measures the time of passing the nip N2 based on drive time of the pair of registration rollers 4 and sends a signal relating to drive control of the motor 46 to the driver. The driver puts drive of the motor 46 on and off based on the signal to put application of the fixing liquid on a transfer paper S by the application roller 44 on and off. Thus, a proper amount of the fixing liquid fed by the feed roller 48 to the application roller 44 is fed to the nip N2 by rotation of the application roller 44, and evenly applied to the transfer paper S at the nip N2.

When the application roller 44 is driven by the motor 46 to rotate to apply the fixing liquid on a transfer paper S, the feed roller 48 is driven by the application roller 44 to rotate to bear or hold a specific amount of the fixing liquid in the liquid room 47 on its circumferential surface, and feeds the fixing liquid to the delivery part D to provide the fixing liquid to the application roller 44. The liquid room 47 and the feed roller 48 form a fixing liquid feed means 56 feeding the fixing liquid to the application roller 44.

The image forming apparatus 100 includes the fixing liquid applicator 41 applying a fixing liquid to a transfer paper S before a toner image is transferred onto, there is no distortion of toner images due to application of the fixing liquid by the application roller 44, no toner adherence to thereto and no defective images due to another adherence of a toner adhering to the application roller 44 to the transfer paper S.

Figure 10:
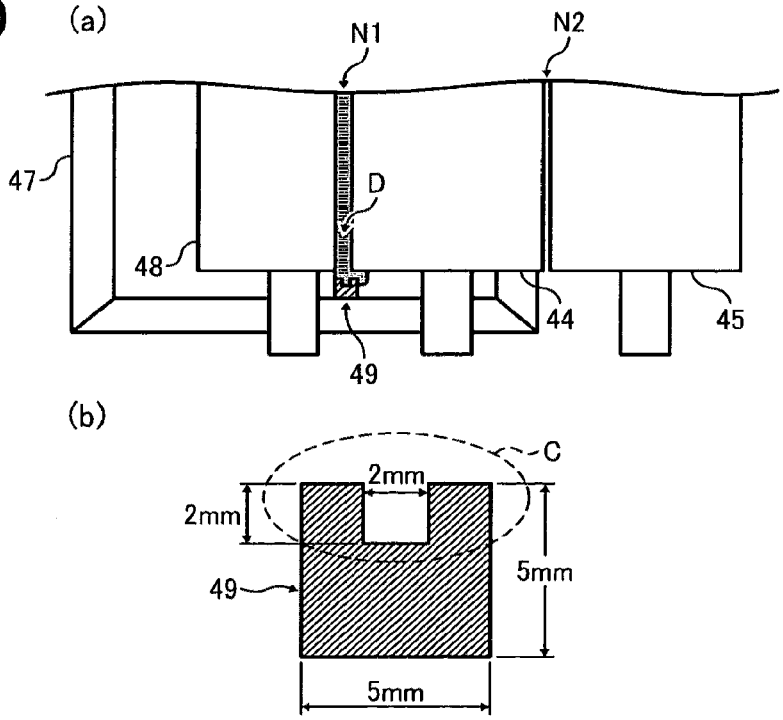
FIGS. 10*a* and 10*b* is an enlarged schematic plane view illustrating another fixing liquid inducing member of the fixing liquid applicator in FIG. 7.
Figure 11:
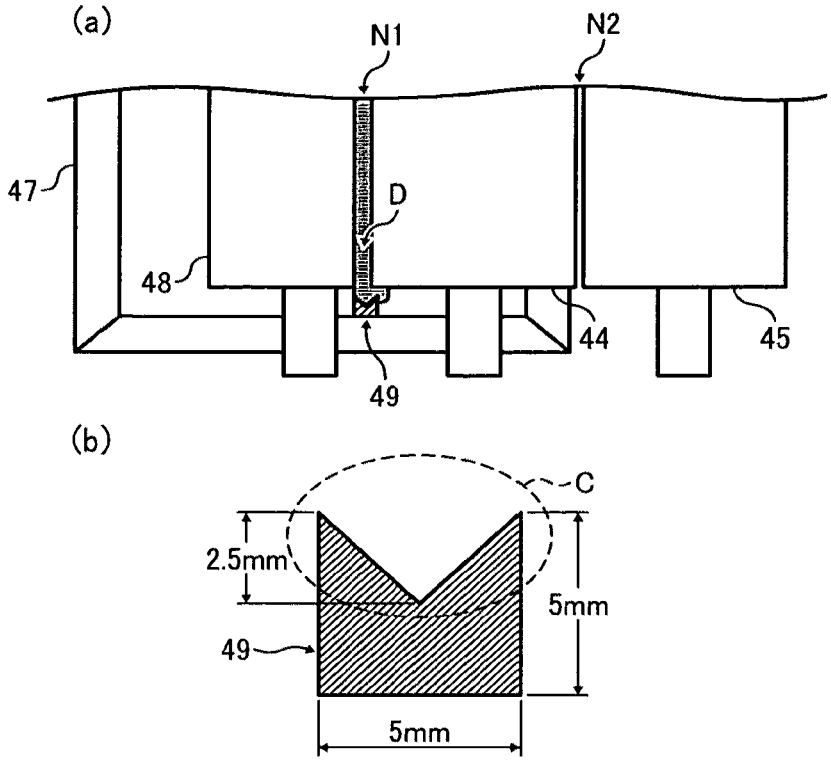
FIG. 11*a* and 11*b* is an enlarged schematic plane view illustrating a further fixing liquid inducing member of the fixing liquid applicator in FIG. 7.

In the image forming apparatus 100, when A4 size plain papers (RICOPY PPC TYPE6200 from Ricoh Company, Ltd.) are used as transfer papers S, as FIGS. 9 and 10 show, an amount, specifically 170 mg of the fixing liquid is uniformly and stably applied throughout a transfer paper S. The amount does not need drying in consideration of heating by the fixing nip 62.

When the paper feed path 81 is formed of guide members such as guide plates guiding a transfer paper S, the guide members are located only at the backside of the transfer paper S at downstream side of the fixing liquid applicator 41 in a feed direction of the transfer paper S, particularly at upstream side of the fixing device 6 where the fixing liquid is dried. Guide members are not located at a surface side applied with the fixing liquid or bearing a toner image of the transfer paper S so as not to contact and impair coating of the fixing liquid or the toner image.

Various fixing liquid induction members 49 are explained. Different points from those of the previously explained ones are mainly explained. The previously explained points are properly omitted.

In FIG. 10, the fixing liquid induction member 49 includes a rectangular groove having a width and a depth of 2 mm respectively at the center of the side surface included in the corner C facing the application roller 44 and the feed roller 48 throughout an extensional direction. The fixing liquid induction member 49 increases in capability of inducing the fixing liquid more than that in FIG. 9 because an area contacting the fixing liquid increase due to the groove.

Figure 14:
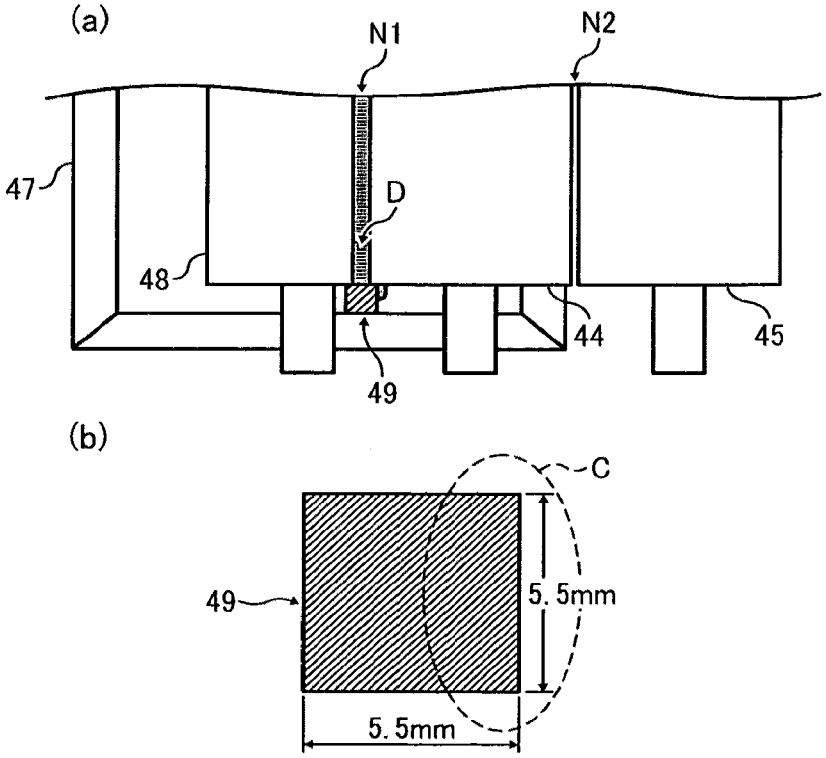
FIGS. 14*a* and 14*b* is an enlarged schematic plane view illustrating another fixing liquid inducing member of the fixing liquid applicator in FIG. 7.
Figure 18:
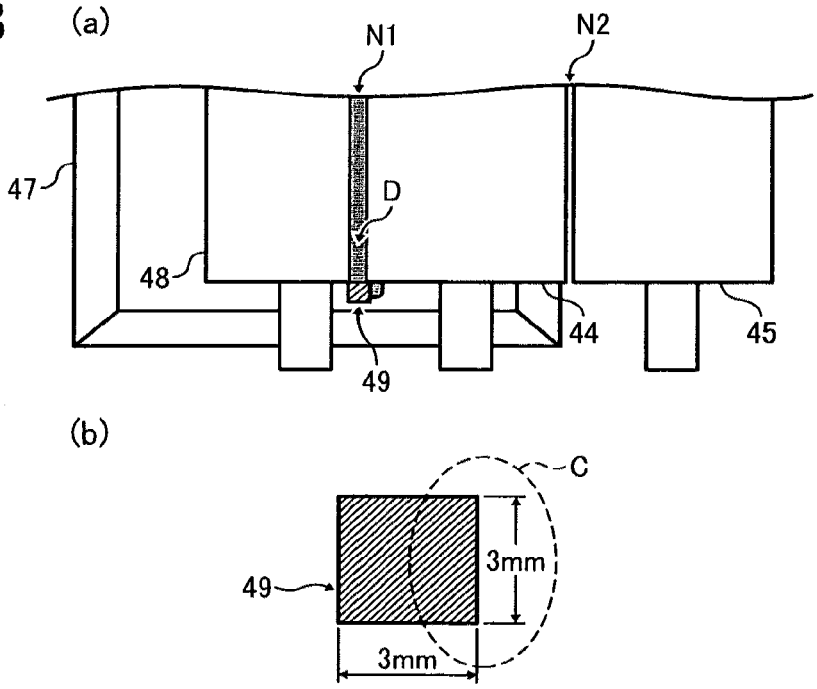
FIGS. 18*a* and 18*b* is an enlarged schematic plane view illustrating another fixing liquid inducing member of the fixing liquid applicator in FIG. 7.

As FIGS. 14 and 18 show, the fixing liquid induction member 49 may be located contacting a side of the delivery part D, specifically an end surface, more specifically a circumferential end surface of the delivery part D of at least one of the application roller 44 and the feed roller 48. In this case, even when an extra amount of the fixing liquid at the delivery part D or flowing out thereof varies, the fixing liquid induction member 49 unfailingly contacts the fixing liquid to exert its induction and cycle capabilities well. Further, the fixing liquid induction member 49 made of POM having good slidability can minimize increase of rotation torque of the application roller 44 due to a friction between the fixing liquid induction member 49 and the application roller 44 or the feed roller 48 and power consumption caused thereby, and minimize viscosity variation of the fixing liquid caused by the friction heat.

Figure 12:
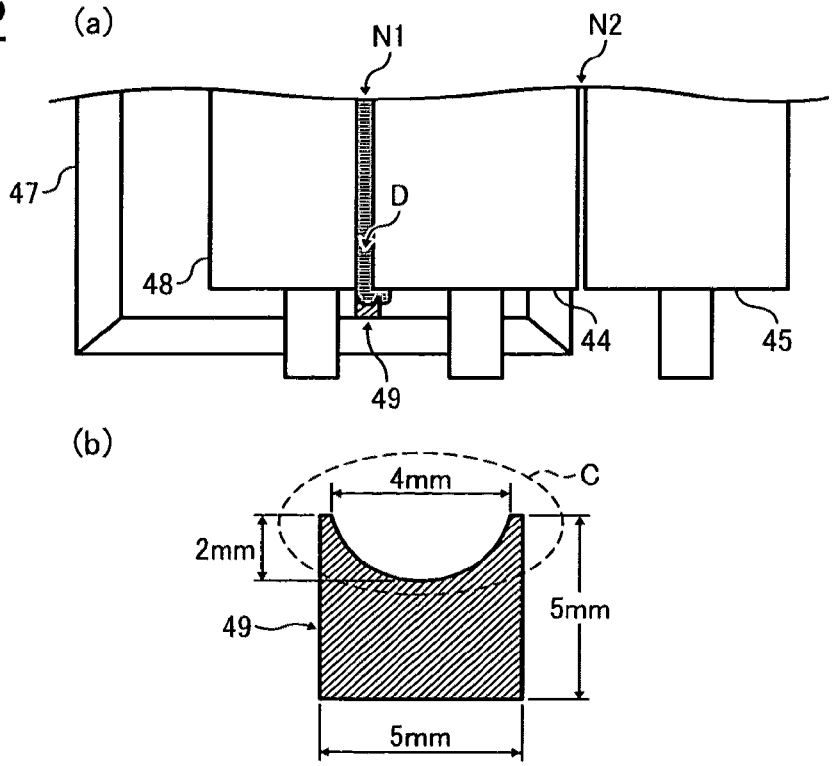
FIGS. 12*a* and 12*b* is an enlarged schematic plane view illustrating another fixing liquid inducing member of the fixing liquid applicator in FIG. 7.
Figure 13:
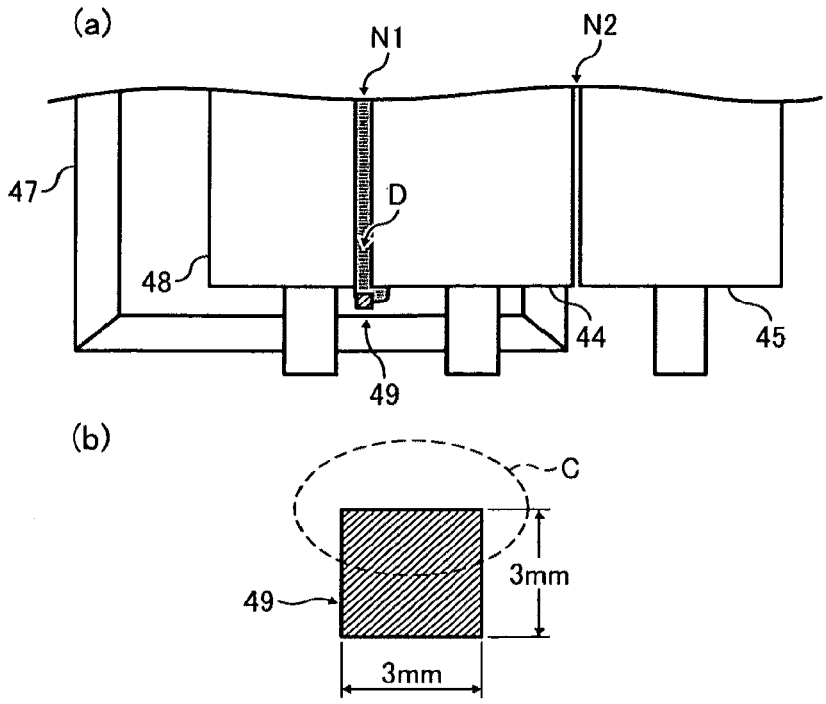
FIGS. 13*a* and 13*b* is an enlarged schematic plane view illustrating a further fixing liquid inducing member of the fixing liquid applicator in FIG. 7.
Figure 17:
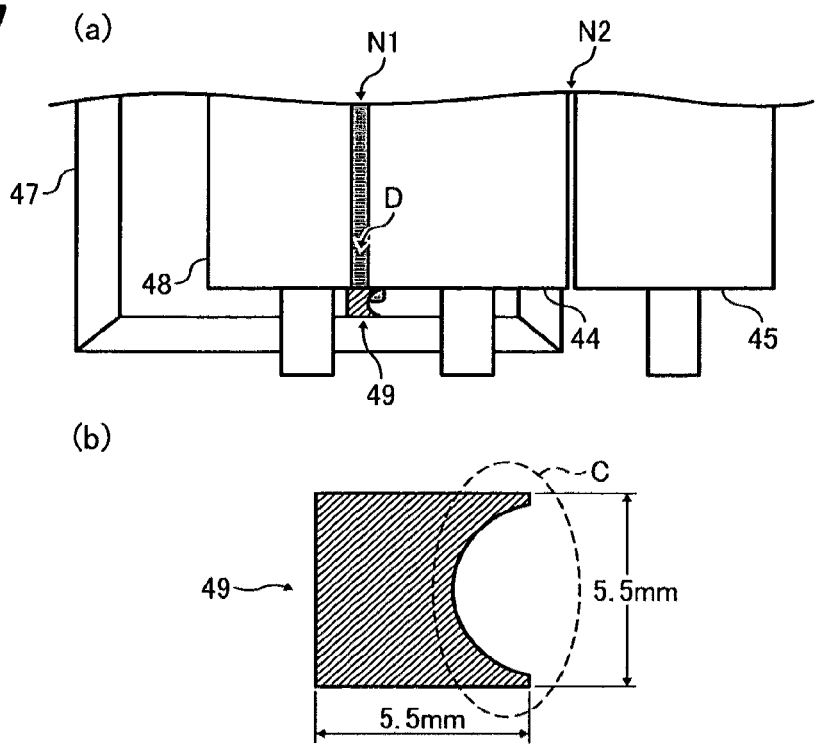
FIGS. 17*a* and 17*b* is an enlarged schematic plane view illustrating a further fixing liquid inducing member of the fixing liquid applicator in FIG. 7.

A cross-sectional shape 49 of the fixing liquid induction member 49 in FIGS. 14 and 18 corresponds to that thereof in FIGS. 9 and 13. When having grooves, their shapes and sizes are identical each other, but the fixing liquid induction members 49 in FIGS. 9 and 12 have a cross-section of 5 mm×5 mm, and the fixing liquid induction members 49 in FIGS. 14 and 17 have a cross-section of 5.5 mm×5.5 mm. The fixing liquid induction members 49 in FIGS. 13 and 18 have a cross-section of 3 mm×3 mm.

Figure 15:
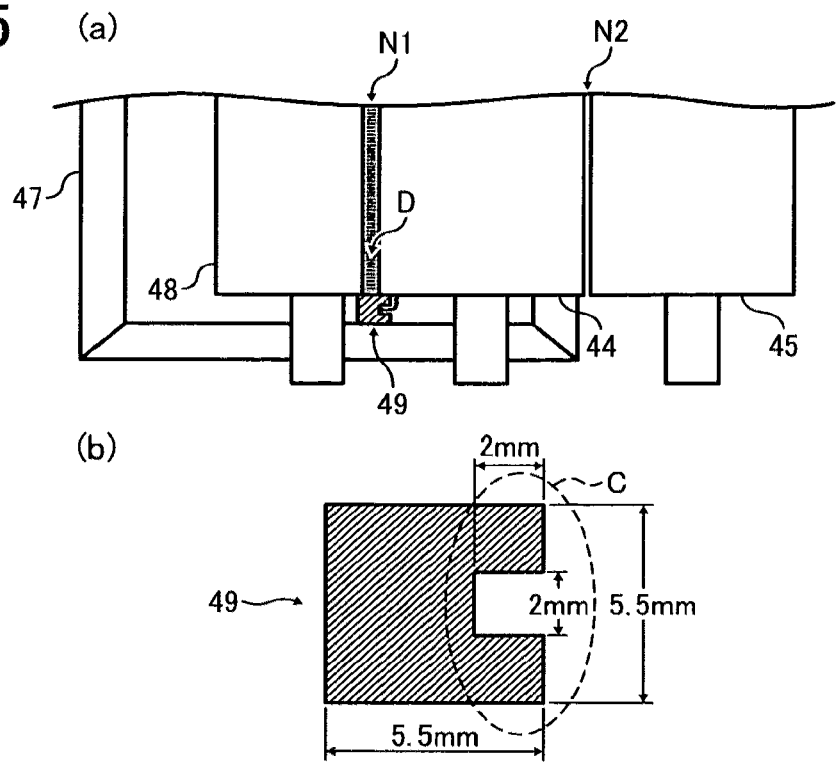
FIGS. 15*a* and 15*b* is an enlarged schematic plane view illustrating a further fixing liquid inducing member of the fixing liquid applicator in FIG. 7.
Figure 16:
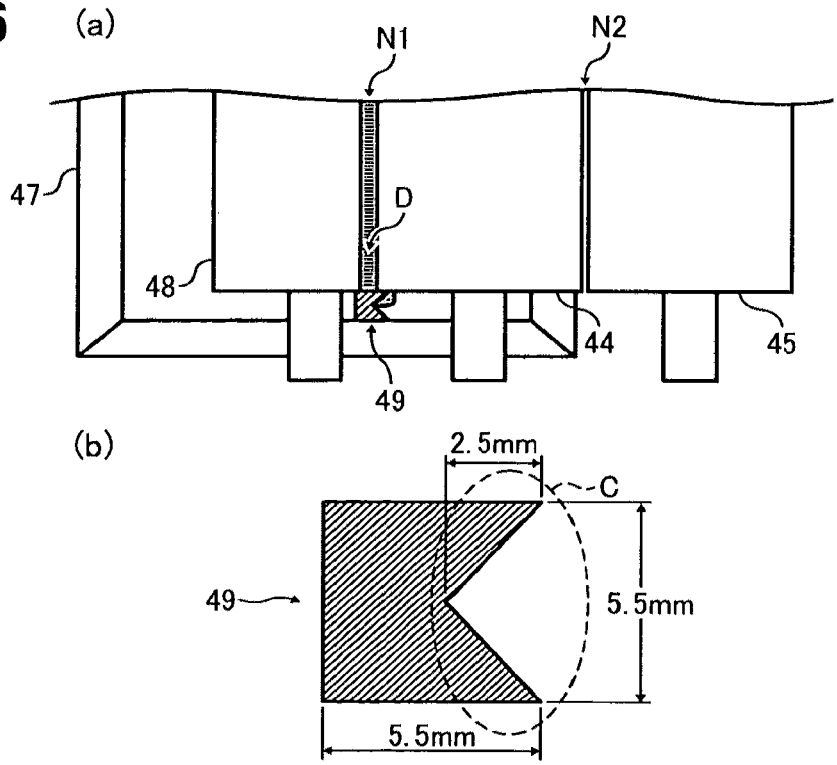
FIGS. 16*a* and 16*b* is an enlarged schematic plane view illustrating another fixing liquid inducing member of the fixing liquid applicator in FIG. 7.

The fixing liquid induction members 49 in FIGS. 14 and 18 have a corner C located differently from that thereof in FIGS. 9 and 13. It is not located at a position facing the application roller 44 and the feed roller 48, but a position shifted at 90° clockwise, facing the application roller 44. Particularly, friction between the groove formed at the corner C of the fixing liquid induction members 49 in FIGS. 15 and 17 and the application roller 44 or the feed roller 48 is prevented, and the grove facing the application roller 44 induces the fixing liquid well.

The rod-shaped fixing liquid induction members 49 extending in one direction has been explained. The fixing liquid induction members 49 may have a curved surface such as circles and Ds without a corner C. Even when the curved surface contacts the application roller 44 or the feed roller 48, increase of rotation torque of the application roller 44 due to a friction with the application roller 44 or the feed roller 48 and power consumption caused thereby are prevented, and a viscosity variation of the fixing liquid caused by the friction heat is prevented.

Figure 19:
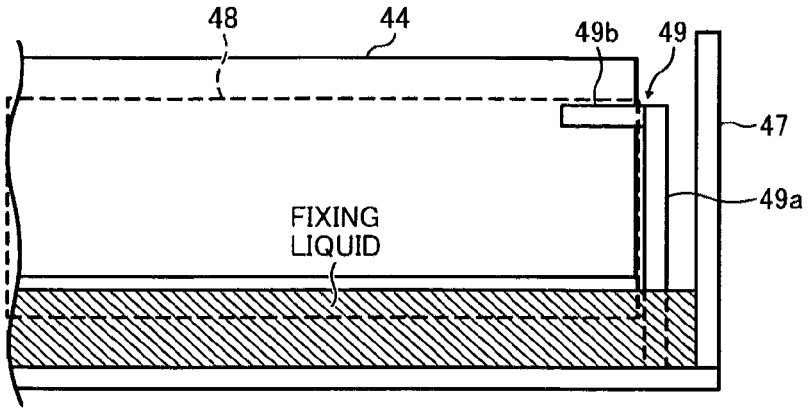
FIG. 19 is a schematic side view illustrating another embodiment of the fixing liquid applicator in FIG. 7.
Figure 20:
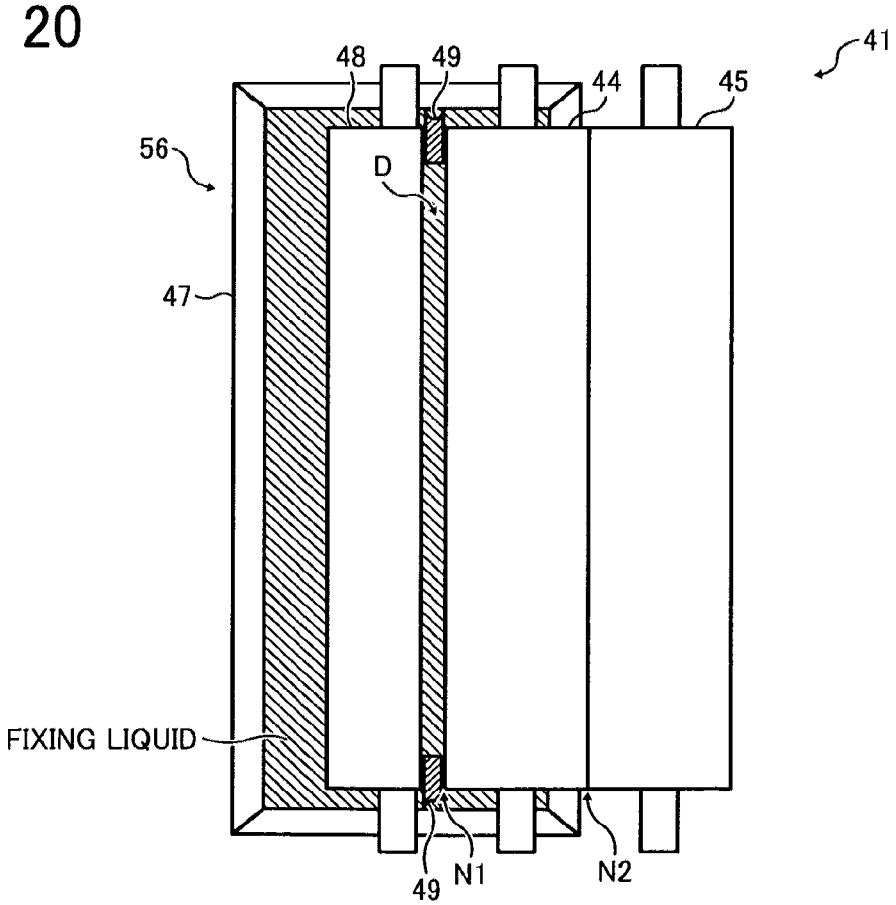
FIG. 20 is a schematic plane view illustrating the fixing liquid applicator in FIG. 19.
Figure 21:
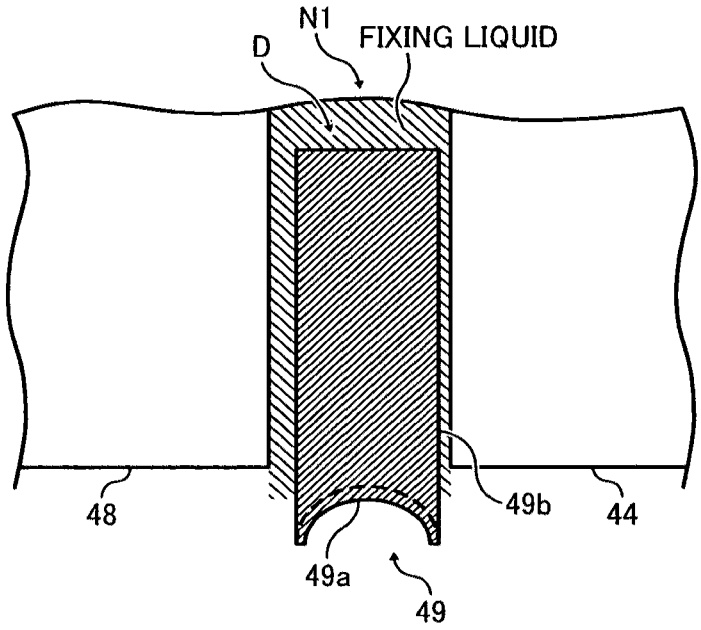
FIG. 21 is an enlarged schematic plane view illustrating a fixing liquid inducing member of the fixing liquid applicator in FIG. 19.

As FIGS. 19 and 21 show, the fixing liquid induction member 49 may be a L-shaped member, not a rod-shaped one extending in one direction. As FIGS. 9 and 18 show, the fixing liquid induction member 49 includes a first part having its extensional direction identical to a vertical direction when the image forming apparatus 100 is normally set, a base 49*a*, the bottom end of which is supported by the liquid room 47, a second part, the base end of which is supported by an apical end of the base 49*a*, and a cullis 49*b* extending in a direction identical to a longitudinal direction of the application roller 44 or the feed roller 48, in other words, the delivery part D or the nip N1. The base 49*a* and the cullis 49*b* are connected with each other at a right angle, and extensional directions of the base 49*a* and the cullis 49*b* bisect each other at right angles.

The lower end of the base 49*a* is fixed on the inner bottom surface of the liquid room 47 apart from the inner side surface. A pipe made of POM having an outer diameter of 4 mm and an inner diameter of 2.5 mm is vertically cracked half to form both of the base 49*a* and the cullis 49*b* halfpipe-shaped. The base 49*a* is located close to the application roller 44 and the feed roller 48 at 0.5 mm not in contact with them, and a concave part which is an opening part in an extensional direction, i.e., the groove faces the inner side surface of the liquid room 47. The cullis 49*b* is located not in contact with the application roller 44 and the feed roller 48 and a concave part which is an opening part in an extensional direction, i.e., the groove faces upward opposite to the nip N1.

Figure 22:
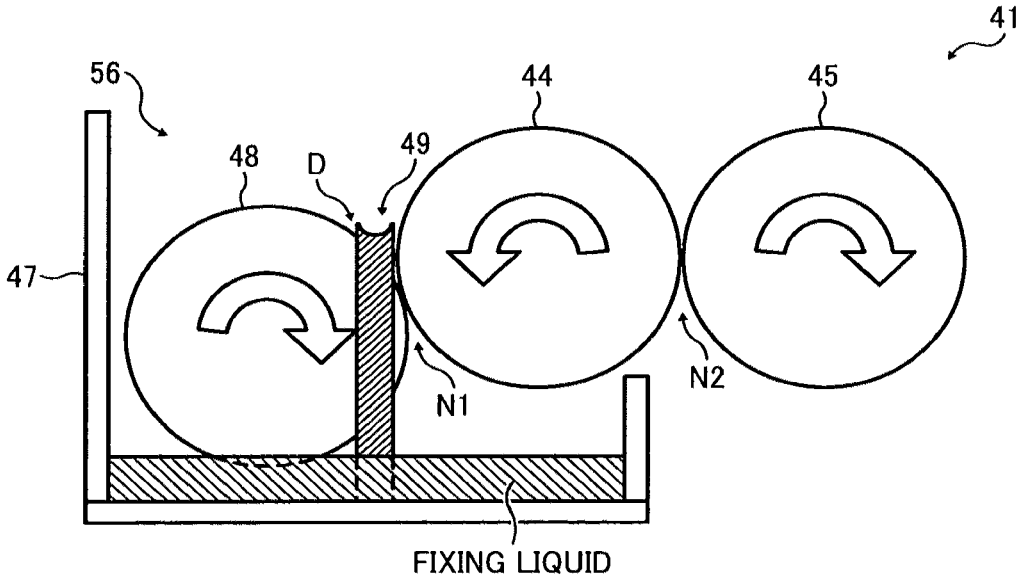
FIG. 22 is a schematic front view illustrating the fixing liquid applicator in FIG. 19.

The base 49*a*, similarly to the fixing liquid induction member 49 in FIGS. 9 and 18, contacts at least one of an extra fixing liquid retained at the delivery part D and another extra fixing liquid flowing out from the side thereof in a longitudinal direction besides a fixing liquid fed from the nip N1 to the nip N2 by the application roller 44 out of a fixing liquid fed to the nip N1 fed thereby at curved surfaces of the application roller 44 and the feed roller 48 as FIG. 22 shows. The extra liquid is transmitted through the curved surfaces due to its weight and surface tension and induced downward out of the delivery part D and returned into the liquid room 47.

Thus, coming around that a fixing liquid having flown out of the delivery part D adheres to the end surface of the application roller 44 and reaches the nip N2 is reduced, and end contamination is prevented and the fixing liquid is uniformly applied to the transfer paper S in a longitudinal direction. Further, the fixing liquid induced by the fixing liquid induction member 49 and flown into the liquid room 47 is ready to be fed again to the nip N1 by the feed roller 48. Unless the fixing liquid is fed to the nip N2 and consumed, the fixing liquid is cycled between the liquid room 47 and the delivery part D and used with high efficiency. The fixing liquid induction member 49 works as a fixing liquid cycle member as well.

Since the fixing liquid induction member 49 does not contact the application roller 44 and the feed roller 48, there is no friction between the fixing liquid induction member 49 and the application roller 44, no increase of rotation torque thereof and power consumption caused thereby, and no viscosity variation of the fixing liquid caused by the friction heat.

Figure 23:
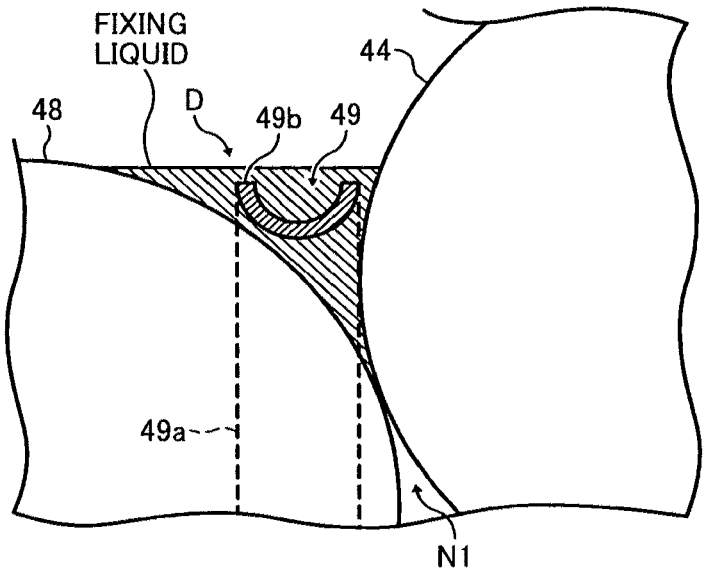
FIG. 23 is a schematic front view illustrating a part of the fixing liquid inducing member of the fixing liquid applicator in FIG. 19.
Figure 24:
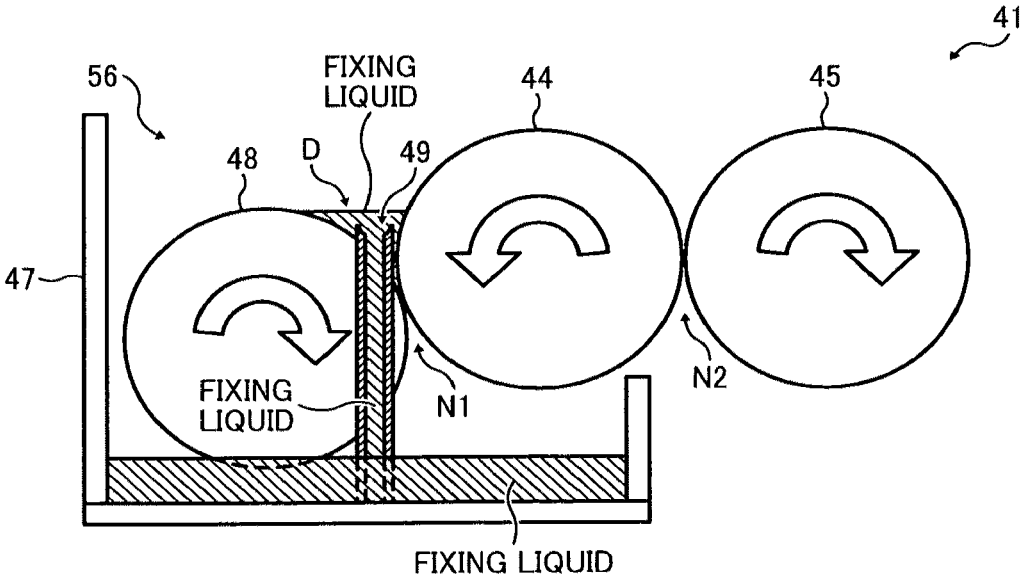
FIG. 24 is a schematic front view illustrating another status of the fixing liquid applicator in FIG. 19.
Figure 25:
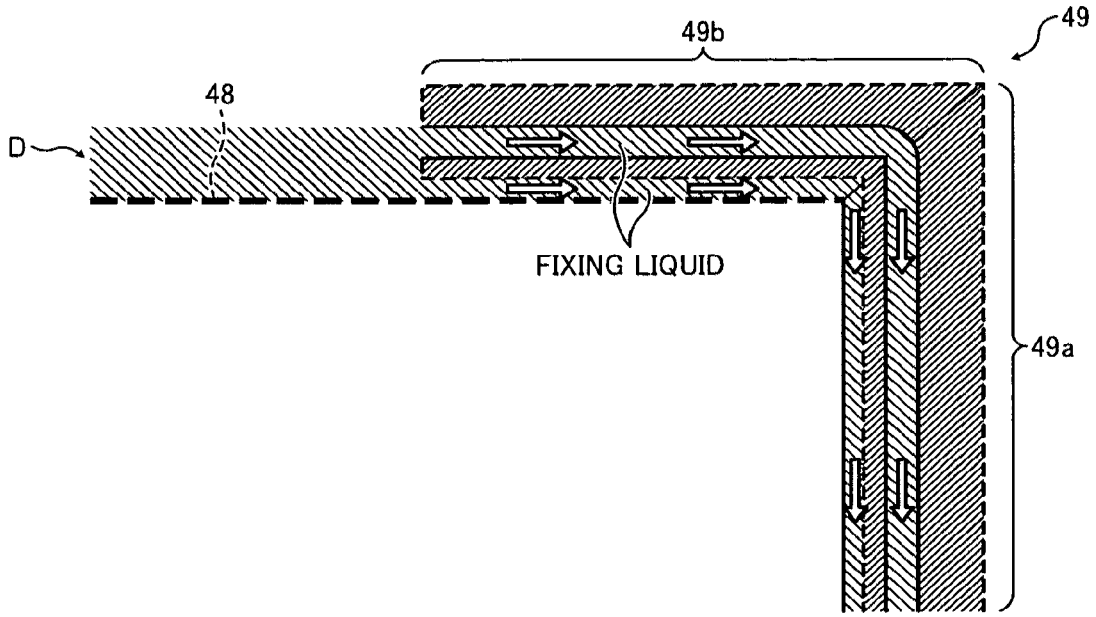
FIG. 25 is an enlarged schematic cross-sectional view illustrating the fixing liquid applicator in FIG. 24.

As FIG. 23 shows, when the fixing liquid retained at the delivery part D increases, for example, when the image forming apparatus 100 is located at a tilt or the fixing liquid varies in viscosity due to the operating temperatures and humidity, the cullis 49*b* contacts the extra fixing liquid retained at the delivery part D such that the extra fixing liquid is transmitted through the cullis 49*b* due to its the surface tension, and guided to the base 49*a* and returned to the liquid room 47. Particularly, the cullis 49*b*, as FIG. 23 shows, when the fixing liquid retained at the delivery part D increases more than entering the groove, contacts the extra fixing liquid retained at the delivery part D even at the upper surface including the grove as FIGS. 24 and 25 show. The extra fixing liquid is transmitted through the upper surface due to its the surface tension, and guided to the base 49*a* and returned to the liquid room 47.

The fixing liquid induction member 49 including the cullis 49*b* includes a first path facing the application roller 44 and the feed roller 48 for inducing the fixing liquid out of the delivery part D to return to the liquid room 47, and a second path not facing the application roller 44 and the feed roller 48. The second path is used when the fixing liquid retained at the delivery part D increases. The first path induces the fixing liquid even when the second path does not. Particularly, the first path for the base 49*a* induces the fixing liquid even when the cullis 49*b* does not.

When a longitudinal direction of the delivery part D is not horizontal, for example, when the image forming apparatus 100 is located at a tilt, the end contamination is likely to occur. The cullis 49*b* induces the fixing liquid retained at the delivery part D increasing and decreasing due to the environment according to an amount thereof to prevent the end contamination and uniformly apply the fixing liquid onto a transfer paper S in a longitudinal direction.

Figure 26:
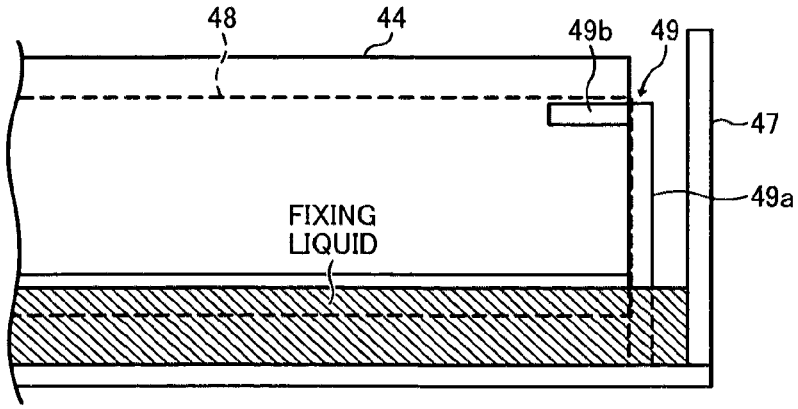
FIG. 26 is a schematic side view of another embodiment of the fixing liquid applicator in FIG. 19.
Figure 27:
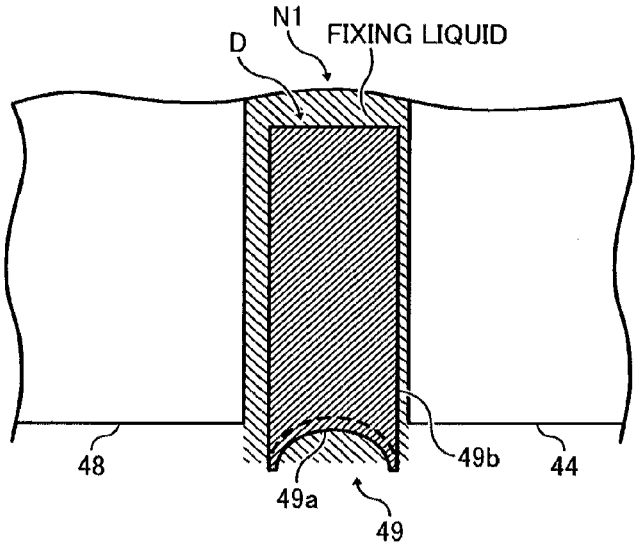
FIG. 27 is an enlarge schematic plane view illustrating a fixing liquid inducing member of the fixing liquid applicator in FIG. 26.
Figure 28:
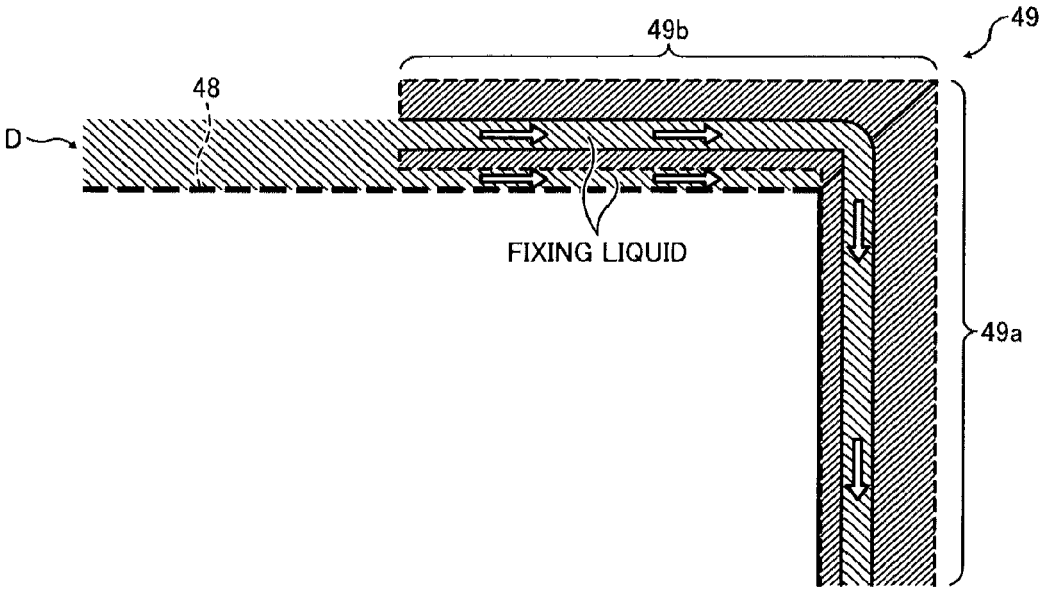

Even the fixing liquid induction member 49 including the cullis 49*b*, similarly to FIGS. 14 and 18, may contact the delivery part D of at least one of the application roller 44 and the feed roller 48. FIGS. 26 and 28 correspond to FIGS. 19, 21 and 25, and the base 49*a* contacts a side, specifically an end surface, and more specifically a circumferential surface of the delivery part D between the application roller 44 and the feed roller 48.

When the fixing liquid induction member is located contacting the delivery part D of at least one of the application roller 44 and the feed roller 48, even when an extra amount of the fixing liquid at the delivery part D or flowing out thereof varies, the fixing liquid induction member 49 unfailingly contacts the fixing liquid to exert its induction and cycle capabilities well. Further, the fixing liquid induction member 49 made of POM having good slidability can minimize increase of rotation torque of the application roller 44 due to a friction between the fixing liquid induction member 49 and the application roller 44 or the feed roller 48 and power consumption caused thereby, and minimize viscosity variation of the fixing liquid caused by the friction heat.

When the fixing liquid induction member 49 has sufficient contact strength against the rotating application roller 44 and the rotating feed roller 48, the cullis 49*b* may be formed contacting the upper surface of the delivery part D of at least one of the application roller 44 and the feed roller 48. Since the curved surface of the fixing liquid induction member 49 contacts the application roller 44 or the feed roller 48, increase of rotation torque of the application roller 44 due to a friction with the application roller 44 or the feed roller 48 and power consumption caused thereby are prevented, and a viscosity variation of the fixing liquid caused by the friction heat is prevented.

The controller 91 memorizes in its memory a fixing program and an image forming program for executing a fixing method and an image forming method of using the fixing liquid applicator 41 applying a fixing liquid including a plasticizer for swelling and softening a toner to suitably be fixed on a transfer paper S before bearing a toner image, a second transferer 5 transferring a toner image on the transfer belt 11 onto the transfer paper S applied with the fixing liquid by the fixing liquid applicator 41 while contacting the toner image to the fixing liquid and a fixing device 6 fixing the toner image transferred by the second transferer 5 on the transfer paper S by heating a toner forming the toner image and the fixing liquid, in which the fixing liquid applicator 41 uses the application roller 44 applying the fixing liquid on a surface of the transfer paper S on which the toner image is transferred by the transferer 5, a feeder 56 feeding the fixing liquid to the application roller 44 and the fixing liquid induction member 49 inducing the fixing liquid retained at the delivery part D where the fixing liquid is fed to the application roller 44 from the feeder 56 out thereof. The fixing program and the image forming program can be stored not only in a memory provided in the controller 91, but also in semiconductive media such as ROM and involatile memories; optical media such as DVD, MO, MD and CD-R; magnetic media such as hard disc, magnetic tape, flexible discs; and other memory media. When the memory media memorize the fixing program and the image forming program, they are computer readable.

Additional modifications and variations of the present invention are possible in light of the above teachings. It is therefore to be understood that within the scope of the appended claims the invention may be practiced other than as specifically described herein.

For example, the shapes of the rotational application member and feed member are not limited to rollers, and may be belts.

When the fixing liquid induction member works as a fixing liquid recycle member, the fixing liquid is induced to a position to be fed again to the feed member, but the position is not limited to the liquid room equipped in the feeder. The feeder is not limited to have a liquid room.

Figure 29:
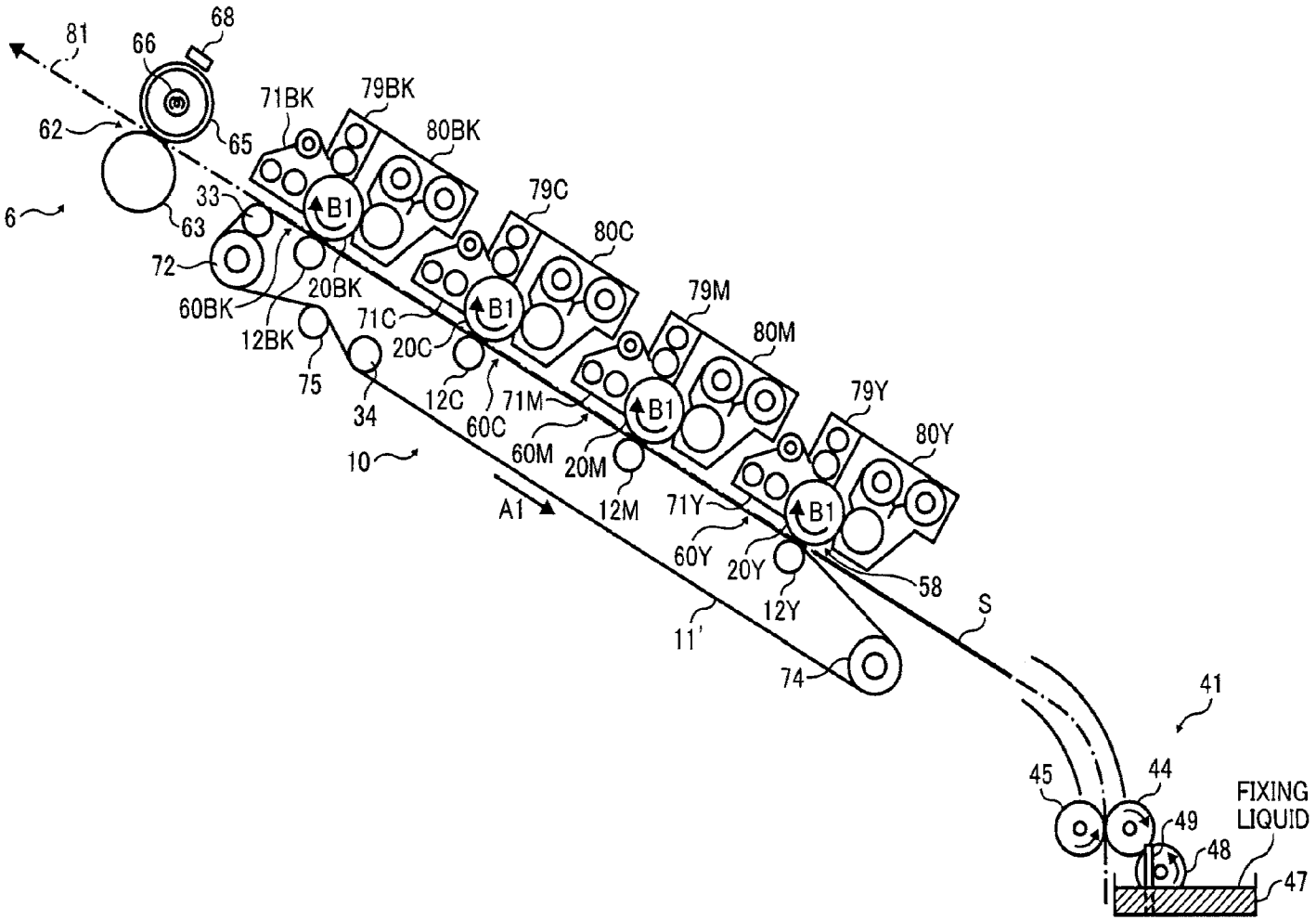
FIG. 29 is a schematic front view illustrating another embodiment of the image forming apparatus of the present invention.

Even the tandem image forming apparatus of the present invention can use a direct transfer method as FIG. 29 shows instead of the above-mentioned indirect transfer method. For the same configurations as those of the above-mentioned image forming apparatus 100, the same numbers are used and the illustrations and explanations are properly omitted.

In a quartet tandem image forming apparatus using a direct transfer method, photoreceptor drums 20Y, 20M, 20C and 20BK bear toner images to be transferred onto a transfer paper S. Instead of the transfer belt 11, a sheet feed belt 11' feeding a recording medium is used.

Each color toner image formed by each image station 60BK, 60C, 60M and 60Y is sequentially and overlappingly transferred by each of the first transfer rollers 12Y, 12M, 12C and 12BK onto a transfer paper S applied with the fixing liquid by the fixing liquid applicator 41, being fed by the sheet feed belt 11', and then the resultant complex color toner image is fixed by the fixing device 6.

Even when the image forming apparatus of the present invention uses a quartet tandem intermediate transfer method and include a transfer belt 11 as an intermediate transferer, a toner borne by a toner bearer, not on a photoreceptor such as the photoreceptor drums 20Y, 20M, 20C and 20BK may be transferred onto the transfer belt 11 to form a toner image thereon.

Figure 30:
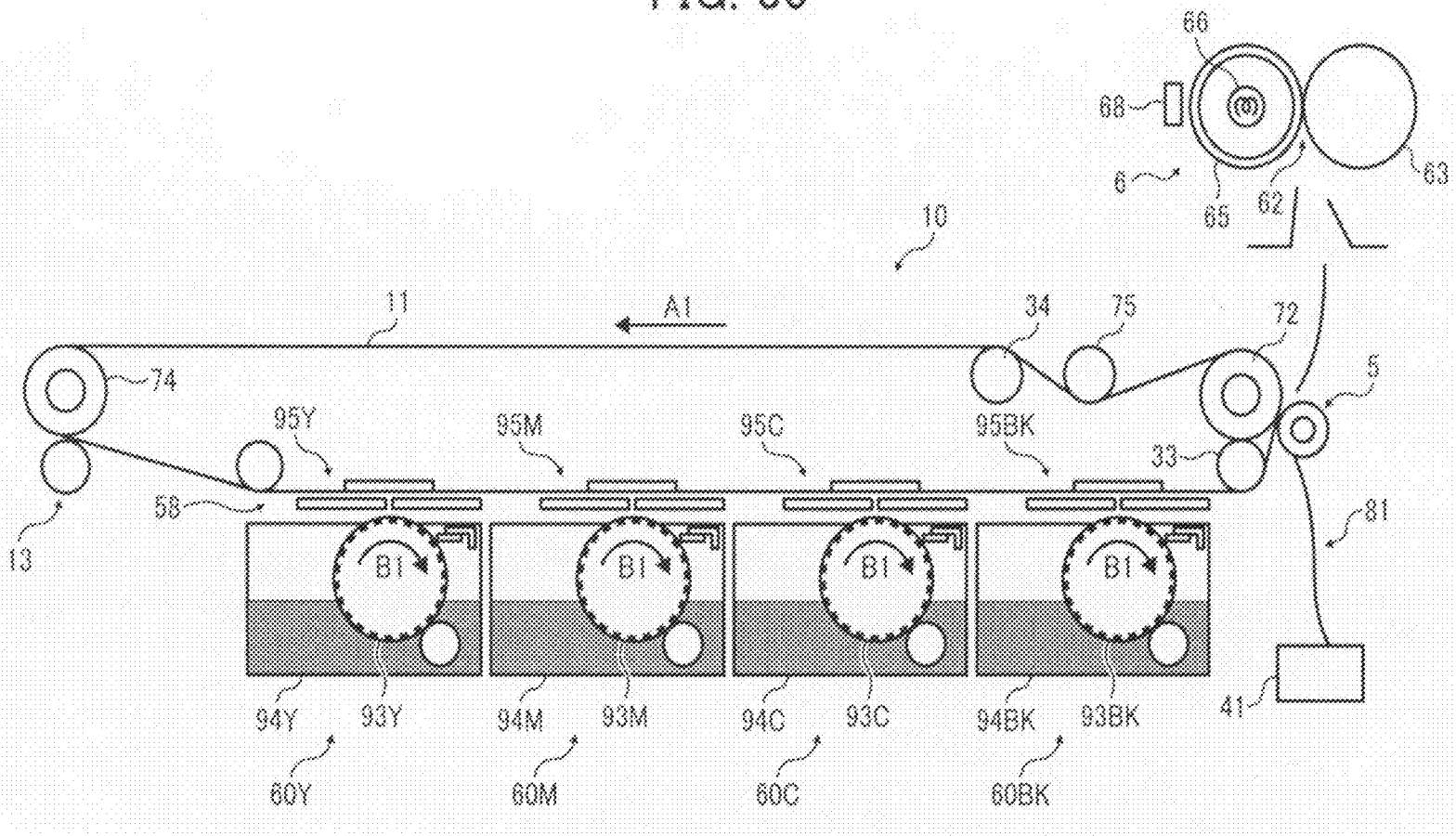
FIG. 30 is a schematic front view illustrating a further embodiment of the image forming apparatus of the present invention.

An embodiment of the image forming apparatus is shown in FIG. 30. For the same configurations as those of the above-mentioned image forming apparatus 100, the same numbers are used and the illustrations and explanations are properly omitted.

The image forming apparatus uses a method of directly recording an image on the transfer belt 11 by flying and landing a toner thereto such as toner jet, direct toning and toner projection. Image forming units 60Y, 60M, 60C and 60BK includes toner bearers 93Y, 93M, 93C and 93BK bearing each yellow, magenta, cyan and black color toner, toner sprayers 94Y, 94M, 94C and 94BK flying the toner borne by each of the toner bearers 93Y, 93M, 93C and 93BK to the transfer belt 11, and toner spray controllers 95Y, 95M, 95C and 95BK having the toner sprayers 94Y, 94M, 94C and 94BK fly the toner to the transfer belt 11 to form an image and including unillustrated toner pass holes the toner flied from each of the toner sprayers 94Y, 94M, 94C and 94BK passes through.

Further, the image forming apparatus of the present invention may be a one-drum image forming apparatus instead of the tandem image forming apparatus, in which each color toner image is sequentially formed and overlapped on one photoreceptor drum.

In addition to the full-color image forming apparatus such as full-color copiers and printers demanded in the market mostly, the image forming apparatus of the present invention may be one capable of forming only monochrome images.

Either two-component or one-component developers can be used.

The fixing device for use in the image forming apparatus of the present invention may use belt fixing methods using an endless-belt-shaped belt instead of the above-mentioned roller fixing methods. The roller fixing methods have an advantage of being capable of evenly heating with comparatively simple configurations and the belt fixing methods have an advantage of being consuming comparatively less electrical power.

The image forming apparatus may be a single copier, printer or a facsimile instead of a combined machine thereof, and other combined machines such as a combination of a copier and a printer.

This document claims priority and contains subject matter related to Japanese Patent Application No. 2010-183487 filed on Aug. 18, 2010, the entire contents of which are herein incorporated by reference.

What is claimed is:

1. An image forming apparatus, comprising:

a fixing liquid applicator configured to apply a fixing liquid to a recording medium prior to formation of a toner image thereon, the fixing liquid including a plasticizer to swell and soften toner forming the toner image to make the toner image suitable for fixing on the recording medium;

a toner image bearer to bear the toner image;

a transferor configured to transfer the toner image on the toner image bearer onto the recording medium while contacting the toner image to the fixing liquid on the recording medium; and a fixing device configured to heat the toner image and the fixing liquid to fix the toner image on the recording medium, wherein the fixing liquid applicator includes:

an application member configured to bear the fixing liquid on its surface and apply the fixing liquid to a surface of the recording medium onto which the toner image is transferred;

a feeder configured to feed the fixing liquid to the application member; and an inducement mechanism configured to induce the fixing liquid pooling at a delivery point where the feeder feeds the fixing liquid to the application member out of the delivery point, wherein the inducement mechanism defines a first part extending in a direction identical to a vertical direction when the image forming apparatus is normally set and a second part extending in a direction identical to a longitudinal direction of the application member and the feeder, and wherein a lower end of the first part is fixed on an inner bottom surface of a liquid room and an upper end of the first part is located close to the application member and the feeder.

2. The image forming apparatus of claim 1, wherein the inducement mechanism is configured to contact at least one of the fixing liquid pooling at the delivery point and the fixing liquid flowing out of a side thereof to induce the fixing liquid out of the delivery point and not contact the application member and the feeder.

3. The image forming apparatus of claim 1, wherein the inducement mechanism is configured to contact the side of at least one of the application member and the feeder where the delivery point is formed, and contacts at least one of the fixing liquid pooling at the delivery point and the fixing liquid flowing out of a side thereof to induce the fixing liquid out of the delivery point.

4. The image forming apparatus of claim 1, wherein the feeder comprises a feed member configured to face the application member to feed the fixing liquid thereto, and the inducement mechanism induces the fixing liquid to a position where the fixing liquid induced out of the delivery point is fed to the feed member again.

5. The image forming apparatus of claim 1, wherein the plasticizer does not swell and soften the toner at ambient temperatures at which the image forming apparatus is used.

6. The image forming apparatus of claim 1, wherein the plasticizer does soften and swell the toner at a temperature higher than an ambient temperature.

7. The image forming apparatus of claim 1, wherein the plasticizer is a solid at an ambient temperature.

8. The image forming apparatus of claim 1, wherein the toner image bearer is a photoreceptor.

9. The image forming apparatus of claim 1, wherein the toner image bearer is an intermediate transferor onto which a toner image borne by a photoreceptor is transferred.

10. The image forming apparatus of claim 1, wherein the toner image bearer is an intermediate transferor onto which toner borne by a toner bearer is transferred to form a toner image.

11. The image forming apparatus of claim 1, wherein the fixing device comprises a roller-shaped fixing member configured to fix the toner image.

12. The image forming apparatus of claim 1, wherein the second part of the inducement mechanism extends at the delivery point.

13. The image forming apparatus of claim 1, wherein the first part and the second part are connected with each other at a right angle.

14. The image forming apparatus of claim 1, wherein extension directions of the first part and the second part bisect each other at right angles.

15. The image forming apparatus of claim 1, wherein centers of the application member and a facing member are located at a same height of each other.

16. The image forming apparatus of claim 1, wherein a center of the feeder is lower than a center of the application member.

17. The image forming apparatus of claim 1, wherein the inducement member is a pair of inducement members.

18. The image forming apparatus of claim 17, wherein each of the pair of inducement member is located at the side of the feeder.

* * * * *